United States Patent [19]

Russell

[11] 4,159,611

[45] Jul. 3, 1979

[54] ENVELOPE PROCESSING MACHINE AND METHOD

[75] Inventor: Robert J. Russell, Camden, N.J.

[73] Assignee: Mail-Ex Corporation, Skokie, Ill.

[21] Appl. No.: 801,454

[22] Filed: May 31, 1977

Related U.S. Application Data

[63] Continuation-in-part of Ser. No. 707,723, Jul. 22, 1976, abandoned.

[51] Int. Cl.[2] ..... B65B 43/30

[52] U.S. Cl. ..... 53/569; 53/571; 53/386; 83/912

[58] Field of Search ..... 53/187, 188, 252, 266 A, 53/381 R, 386, 390, 391, 569, 570, 571; 83/912; 214/304, 305; 271/150

[56] References Cited

U.S. PATENT DOCUMENTS

| | | | |
|---|---|---|---|
| 1,867,973 | 7/1932 | Keiser | 83/912 |
| 2,027,045 | 1/1936 | Keiser | 83/912 |
| 2,057,284 | 10/1936 | Walker | 53/390 |
| 2,788,627 | 4/1957 | Bellows | 53/266 A |
| 2,847,213 | 8/1958 | Duncanson et al. | 271/150 X |
| 2,865,155 | 12/1958 | Nydegger | 53/266 A X |
| 3,143,100 | 8/1964 | Krupotich | 53/381 R |
| 3,214,880 | 11/1965 | Berg | 53/123 X |
| 3,384,252 | 5/1968 | West | 83/912 X |
| 3,566,578 | 3/1971 | Thorne et al. | 53/386 X |
| 3,813,847 | 6/1974 | Kuhnle | 53/187 X |
| 3,884,010 | 5/1975 | Bardo et al. | 83/912 X |
| 3,943,807 | 3/1976 | Bingham et al. | 83/912 X |
| 3,979,884 | 9/1976 | Russell | 53/381 R |
| 4,016,708 | 4/1977 | DeHart | 83/912 |

*Primary Examiner*—John Sipos

*Attorney, Agent, or Firm*—Trexler, Wolters, Bushnell & Fosse, Ltd.

[57] ABSTRACT

The present invention provides a machine and method wherein envelopes are removed from a supply hopper, one by one; transmitted to a cutting station wherein one edge of the envelope optionally may be severed; the envelope then being transmitted to a processing station at which the envelope is opened and held open by suction cups, for removal or insertion of contents by an operator. The envelope is thereafter transmitted to a detector station and then to a recovery station and then to a point of discharge. The dwell time of the envelope at the processing station may be adjusted as desired by the operator.

21 Claims, 39 Drawing Figures

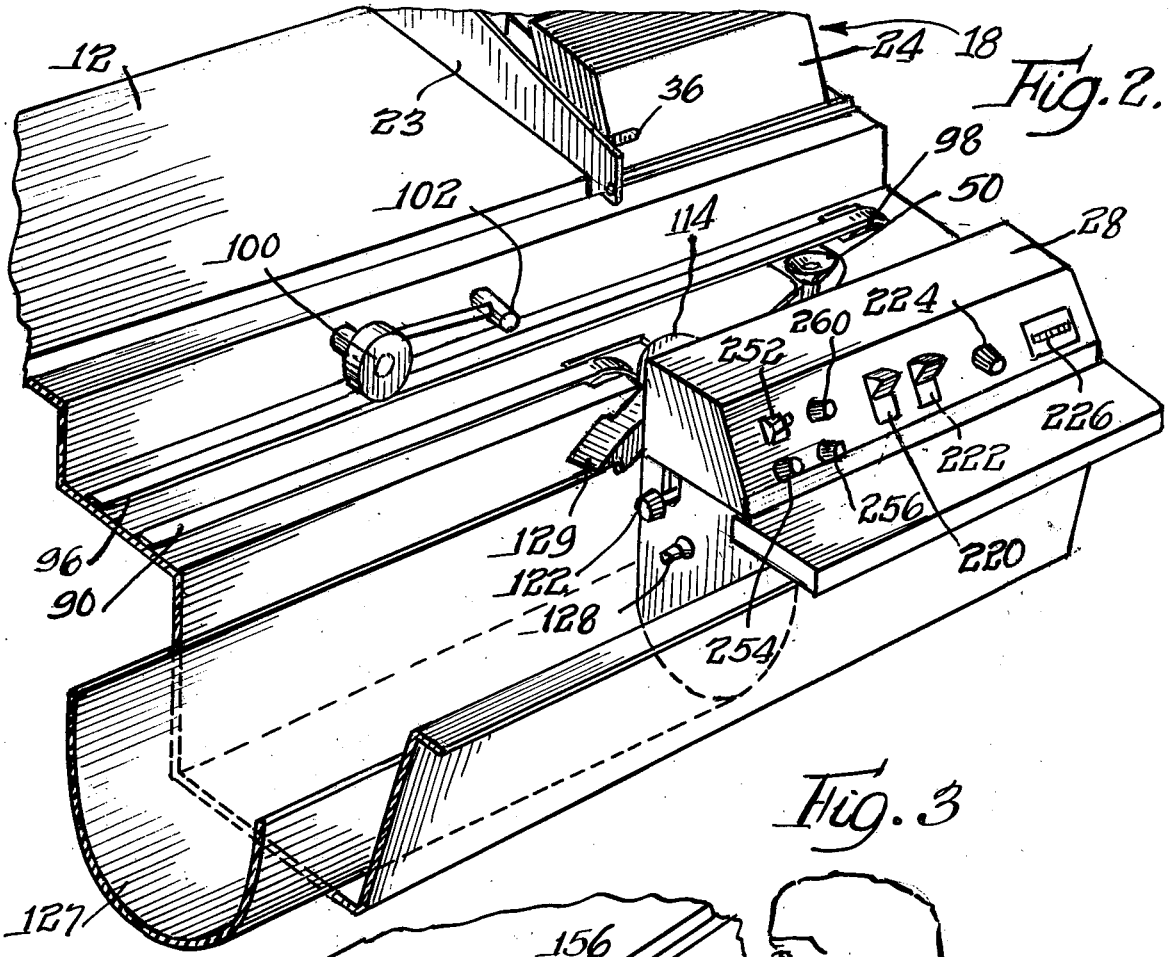
Fig. 2.
Fig. 3
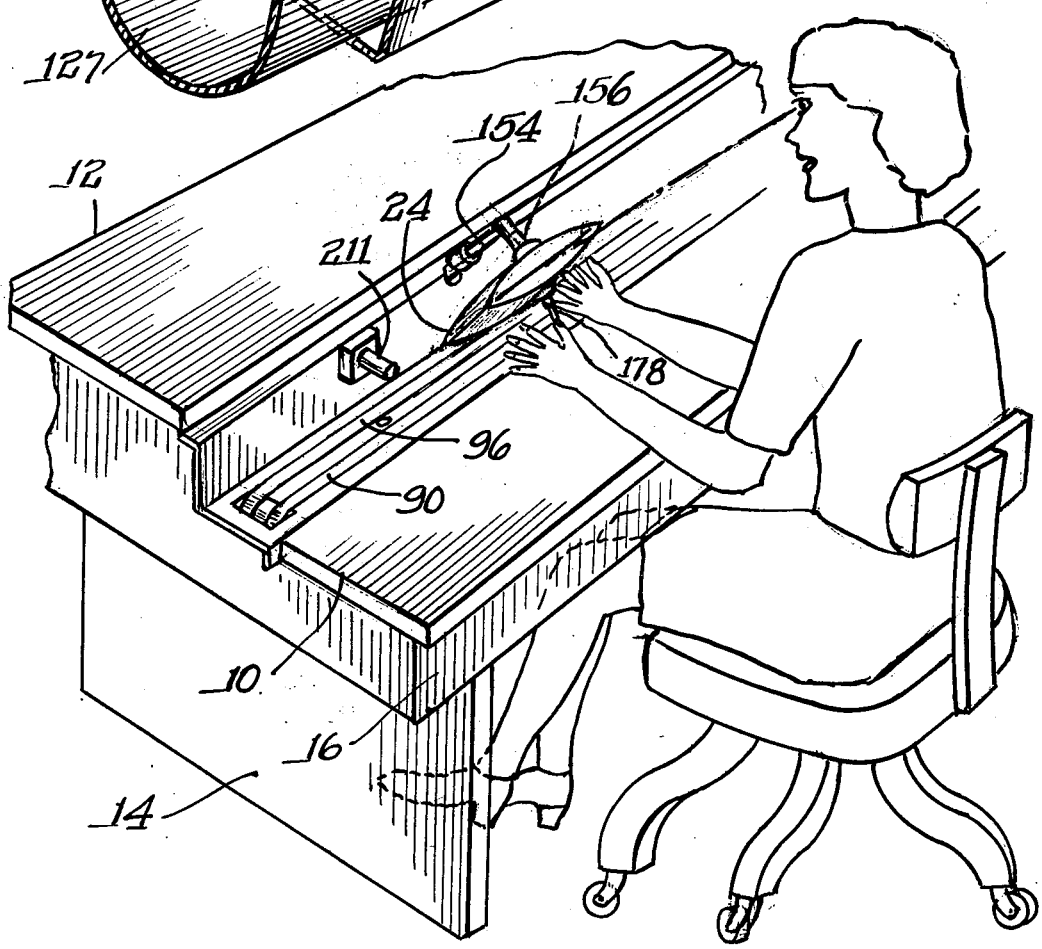

10
90
96
211
156
154
164
151
152
163
161
150
162
202
204
210
206
160
180
182
168
170
166
146
208
65
66
68
158
54
72
56
64
58
62
236
238
234
232
60
59
73
75
69
127
212

10
12
24
62
64
65
69
90
96
148
151
154
156
160
162
164
166
172
174
178
184
202
204
232
234

Fig. 23.
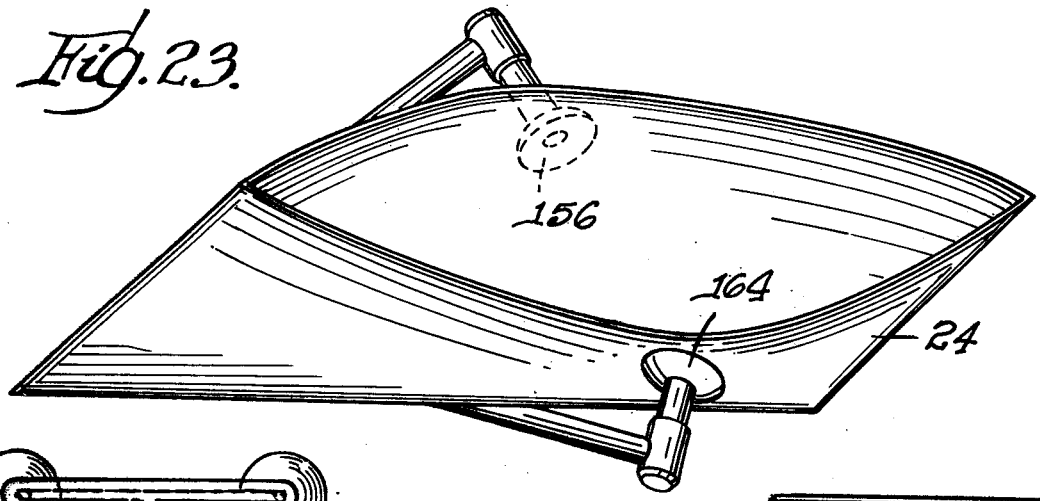
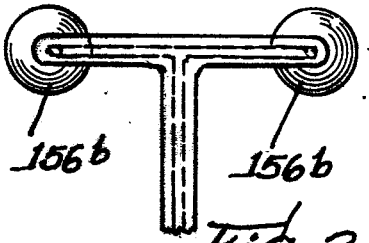
Fig. 24.
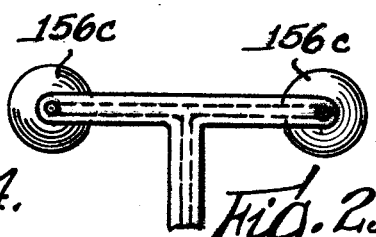
Fig. 25.
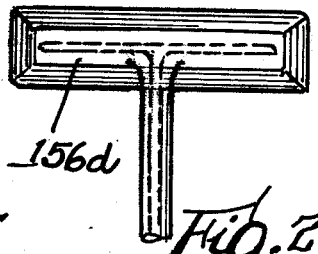
Fig. 26.
Fig. 27.
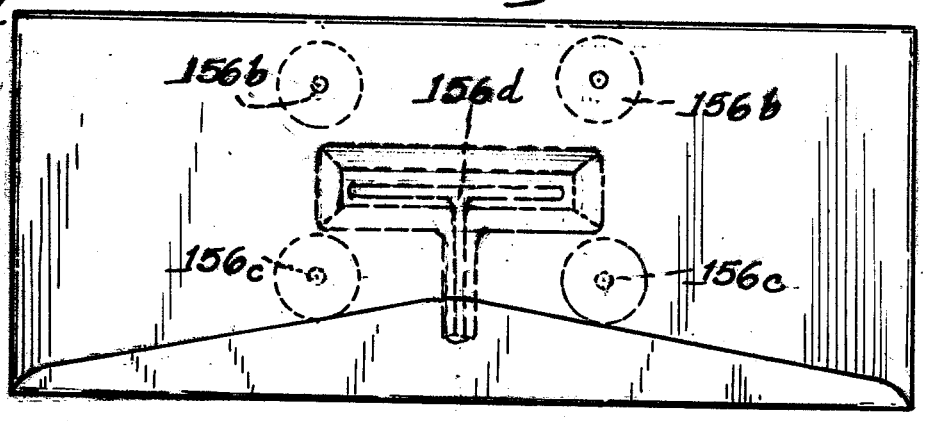
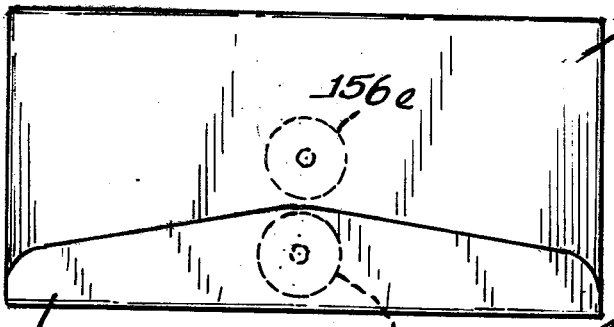
Fig. 28.
Fig. 29.
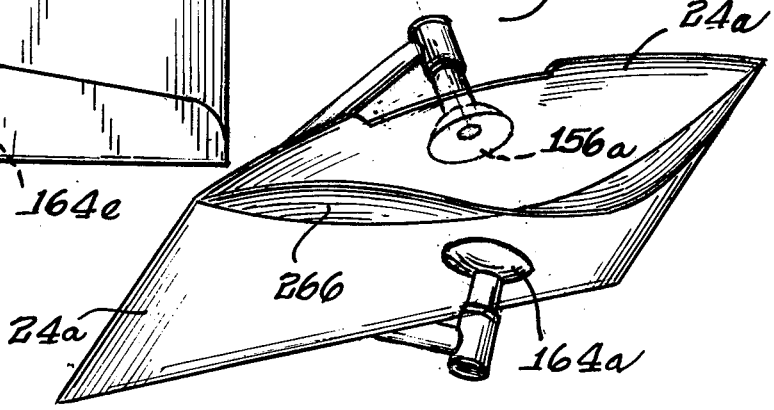

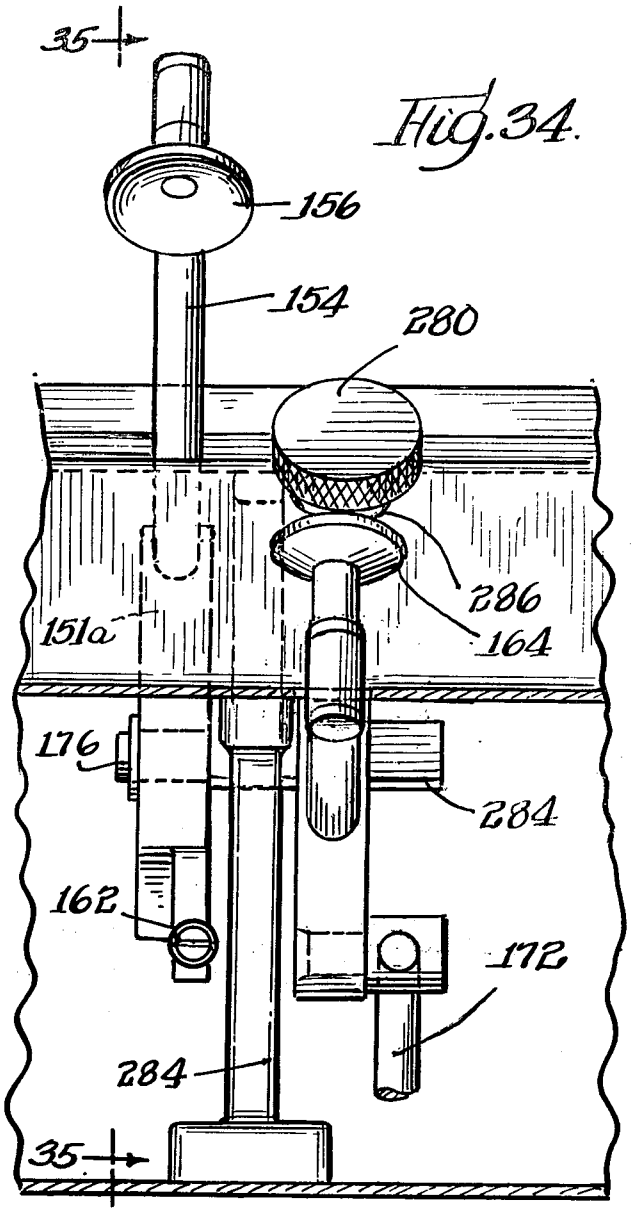
Fig. 34.
156
154
280
286
164
284
172
151a
176
162
284
35
35
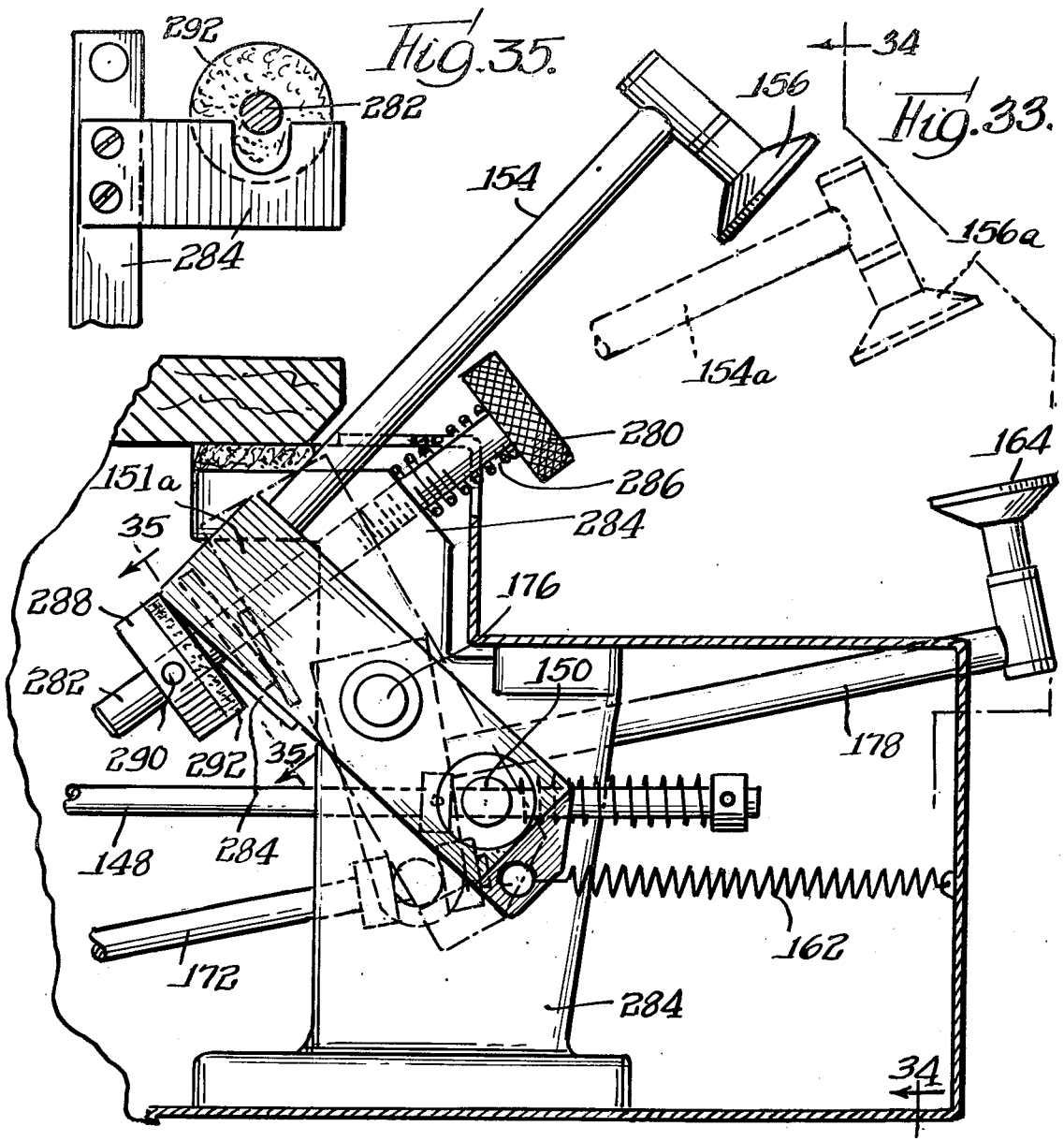
Fig. 33.
156a
164
34
156
154a
154
178
162
34
280
286
284
176
150
284
Fig. 35.
282
292
284
151a
35
288
282
290
292
35
284
148
172

ENVELOPE PROCESSING MACHINE AND METHOD

This application is a continuation-in-part of my prior application, Ser. No. 707,723, filed July 22, 1976, entitled Envelope Opening Machine, now abandoned.

The present invention relates to an envelope processing machine and method.

Envelope processing machines are known to the the prior art wherein envelopes are removed from a supply hopper, transmitted to a cutting station wherein one edge of the envelope is cut open, and then transmitted to a removal station wherein the envelope is opened and the contents mechanically extracted. One such machine is set forth in the U.S. Pat. to West No. 3,384,252. The present invention provides for the manual removal or insertion of the contents of the envelope at the processing station, thus avoiding the complexity and problems incident to the operation of mechanical processing means.

Envelope processing machines are also known in the prior art wherein precut envelopes are removed from a supply hopper and transmitted to a station wherein the envelope is opened and held open, for manual removal of the contents; but in at least certain of these machines, the attitude and position of the envelope at the removal station is such that inspection of the interior of the envelope, and removal or the contents becomes relatively difficult.

In accordance with the present invention an envelope processing machine is provided, of improved construction and reliability, wherein envelopes of different size may be arranged within a supply hopper in stacked relation, the envelopes being reliably removed from the hopper, one by one, and transmitted to a cutting station wherein one edge of the envelope optionally may be cut off. Means is provided for transmitting the envelope along a predetermined path to the cutting station, whereby to insure that the cutting operation may be accurately effected, and adjustment means is provided at the cutting station for predetermining whether a cut is to be made and the degree of cut to be made. Thereafter the envelope is transmitted from the cutting station to a processing station wherein the envelope is opened and held open by suction cups, in an attitude which permits ready inspection of the interior of the envelope and ready removal or insertion of the envelope contents. Means is provided for adjusting the length of time that the envelope is held at the processing station, in accordance with the nature of the particular work being done, and the desires of the operator. After removal or insertion of the envelope contents, as the case may be, the envelope is transmitted to an inspection station, and then to a recovery station and then to a discharge station.

It is an object of the present invention to provide a machine of the foregoing type, of improved and simplified construction, and of improved reliability in operation.

One object of the invention is to provide, in a machine of the foregoing type, an improved hopper structure into which envelopes of varying sizes may be introduced in any desired order, and from which the envelopes will be reliably removed, one by one, for transmission to the processing stations of the machine.

Another object of the invention is to provide in a machine of the foregoing type, an improved feeding mechanism for transmitting the envelopes from the supply hopper to the cutting station, whereby to insure that the cutting operation upon the envelope edge will be accurately performed. A further object is to provide suitable adjustment means, at the cutting station, to adjust the depth and character of the cut effected.

A further object of the invention is to provide in a machine of the foregoing type, an improved arrangement at a processing station whereby the envelope is opened and held open in a desirable attitude and position for inspection of the envelope interior, and removal or insertion of contents by the operator.

A further object of the invention is to provide, in a machine of the foregoing type, suitable adjustment and control means whereby the travel of the envelope from the cutting station to the processing station may be accurately controlled to insure a proper positioning of the envelope at the processing station, and wherein the dwell time of the envelope at the processing station may be controlled by the operator as desired in accordance with the requirement of the particular envelopes being processed.

A further object of the invention is to provide, in a machine as described, an improved inspection and recovery arrangement for the processed envelope.

A particularly important object of the present invention is the means for determining the attitude and accessibility of the envelope at the processing station. The envelope is opened, and held opened, in an attitude which permits an operator comfortably seated in front of the machine to readily inspect the interior of the opened envelope without strain or movement. This minimizes operator fatigue. Ready inspection of the interior of the envelope also facilitates removal or insertion of contents. Further, at the processing station the sidewalls of the envelope are accessible, exteriorly and interiorly, so that contents of the envelope tending to adhere to the envelope sidewall may be readily removed, when the machine is being utilized for content removal. Removal is facilitated even though the suction means may cause the contents to adhere to the envelope wall.

A still further object of the invention is to provide a method for processing envelopes in accordance with the above.

Various other objects, advantages and features of the invention will be apparent from the following specification, when taken in connection with the accompanying drawings, wherein a preferred embodiment of the invention is set forth for purposes of illustration.

In the drawings wherein like reference numerals refer to like parts throughout:

FIG. 2 is a partial perspective view of the right-hand end of the machine, as seen from the front;

FIG. 3 is a perspective view of the machine, more particularly showing the attitude of an opened envelope at the processing station, for ready accessibility to the operator.

Figures 19, 19A, 20:
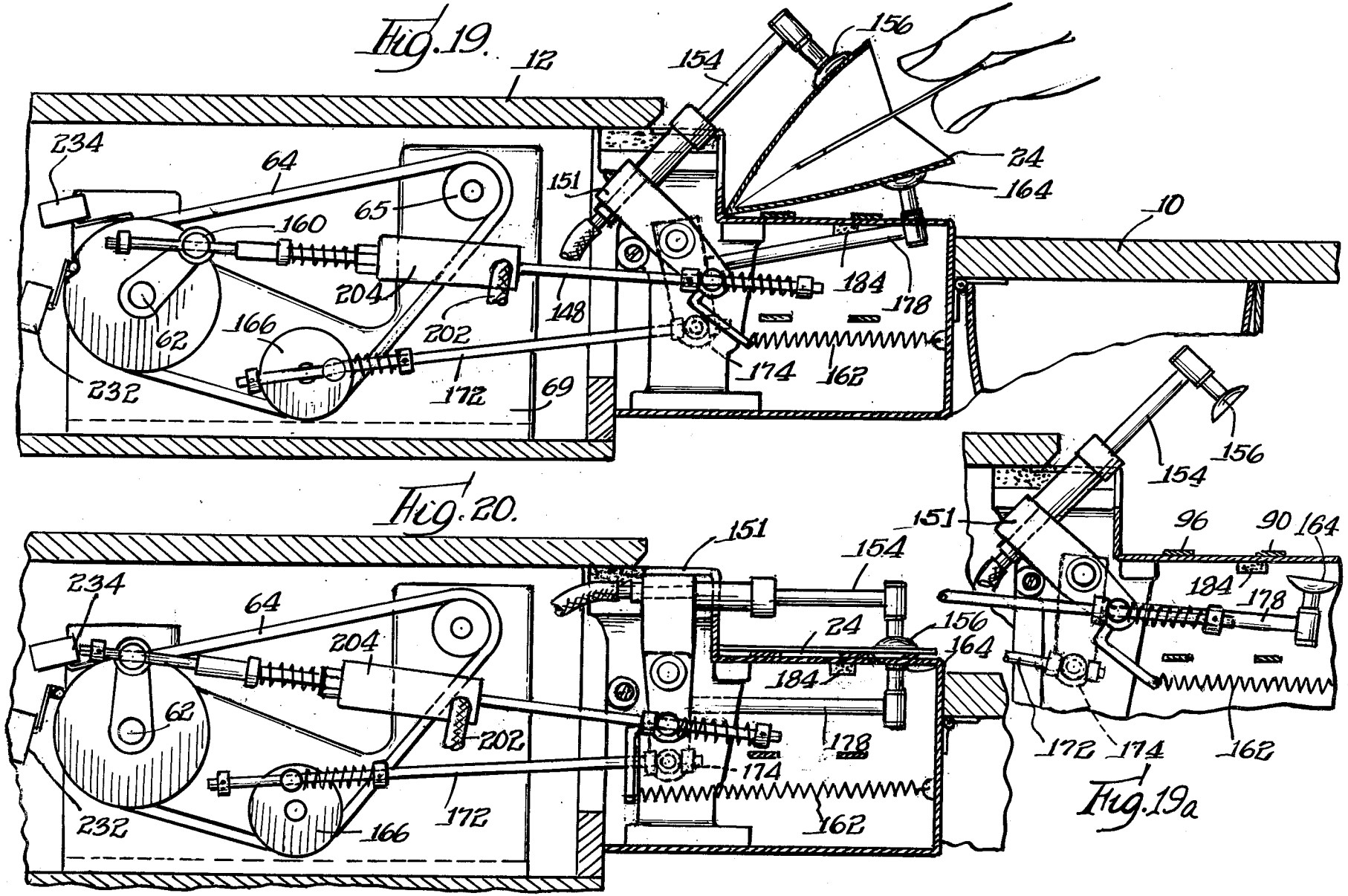
FIG. 19 is a side view of the mechanism shown in FIG. 16, taken as indicated by the line 19—19 of FIG. 4.

FIG. 19*a* shows some of the parts shown in FIG. 19 in a different operating position;

FIG. 20 is a view of the mechanism of FIG. 19 is a different operating position

Figure 1:
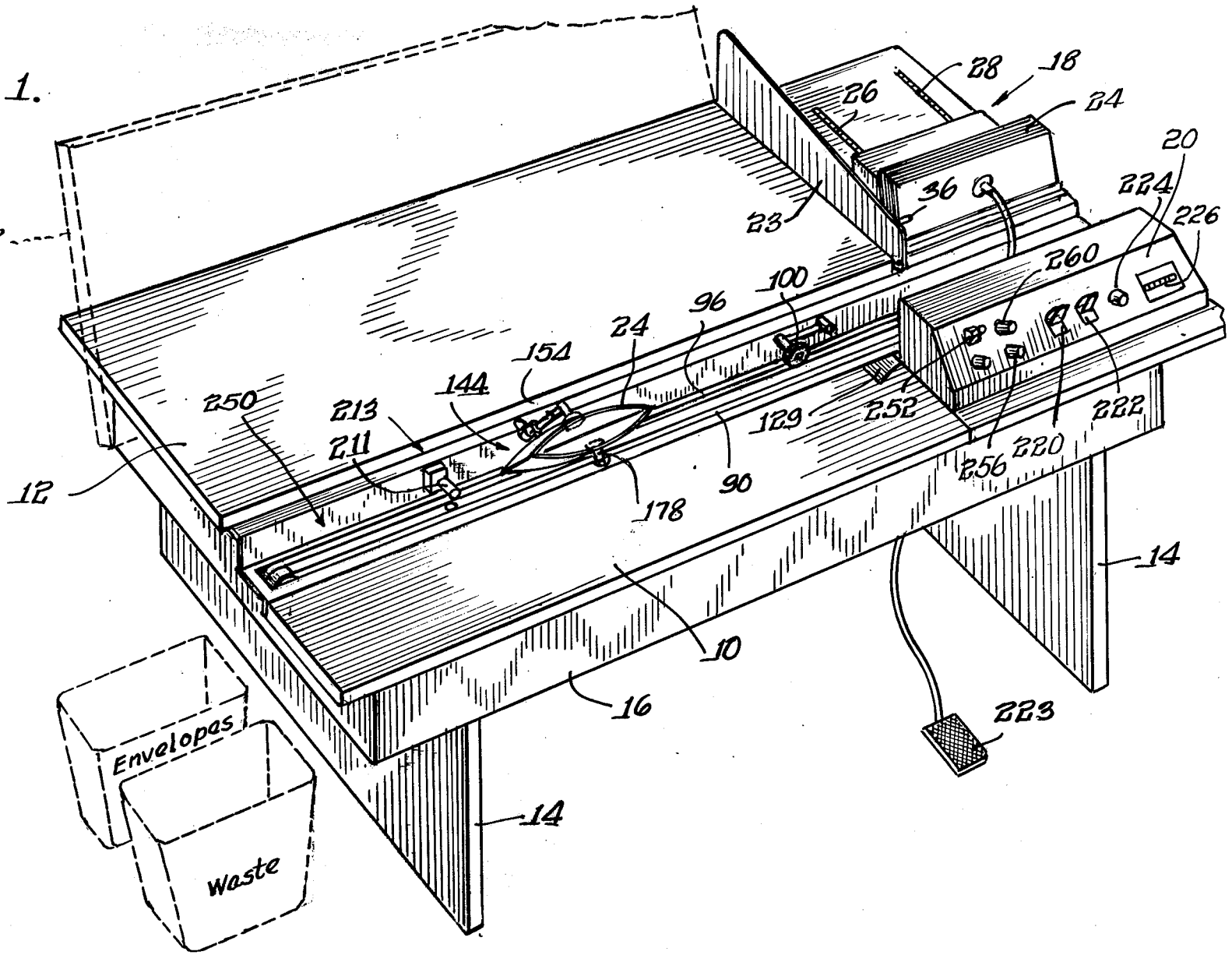
FIG. 1 is a general perspective view showing the machine of the present invention, in accordance with one selected embodiment thereof.
Figure 21:
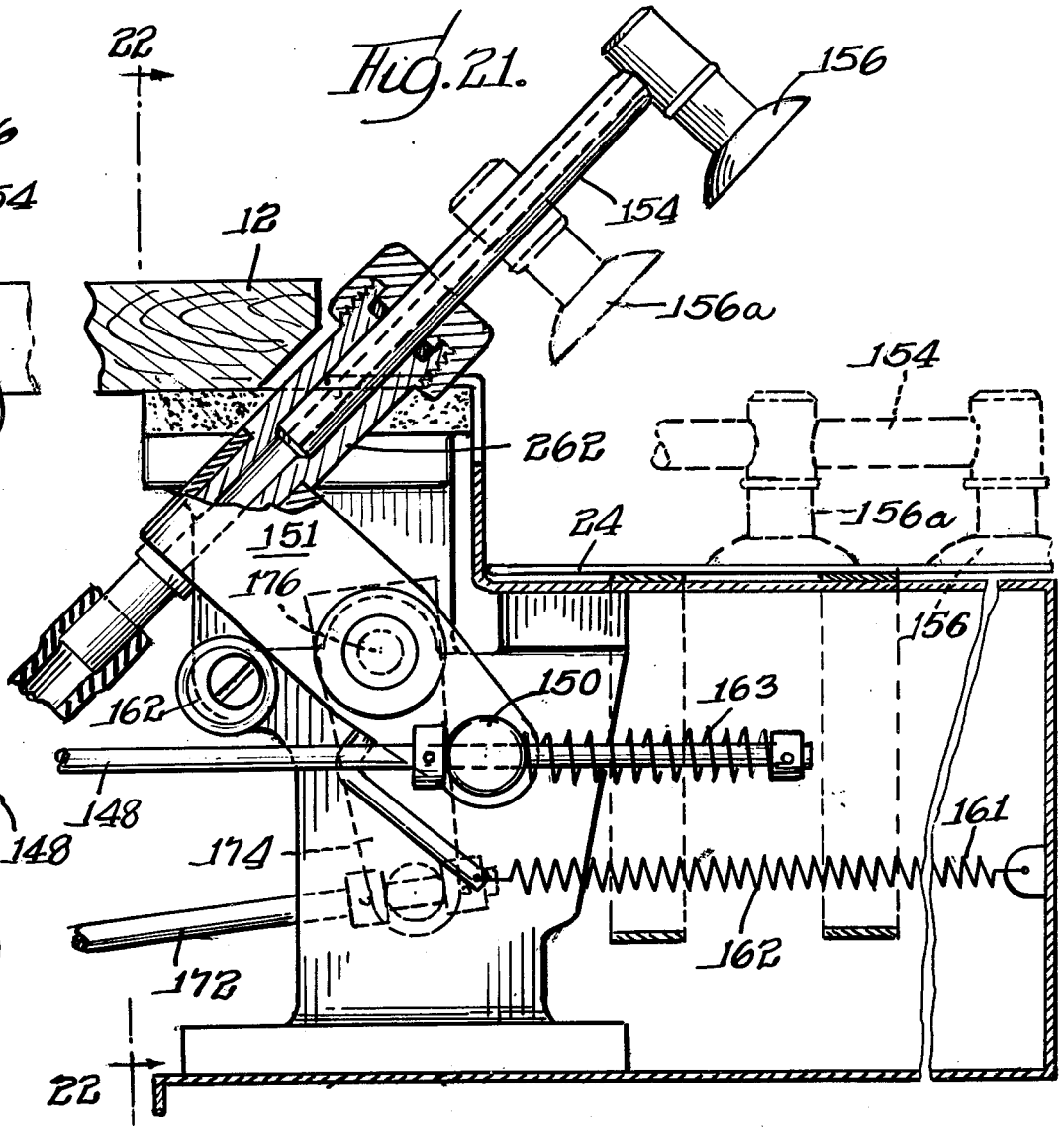
Figure 22:
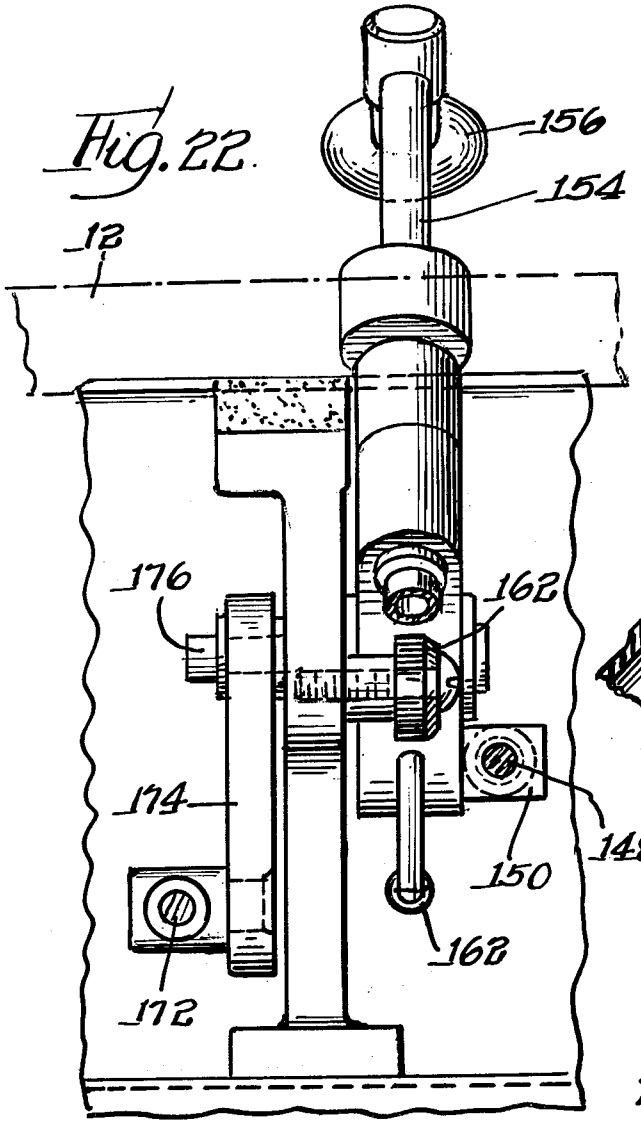
Figure 30:
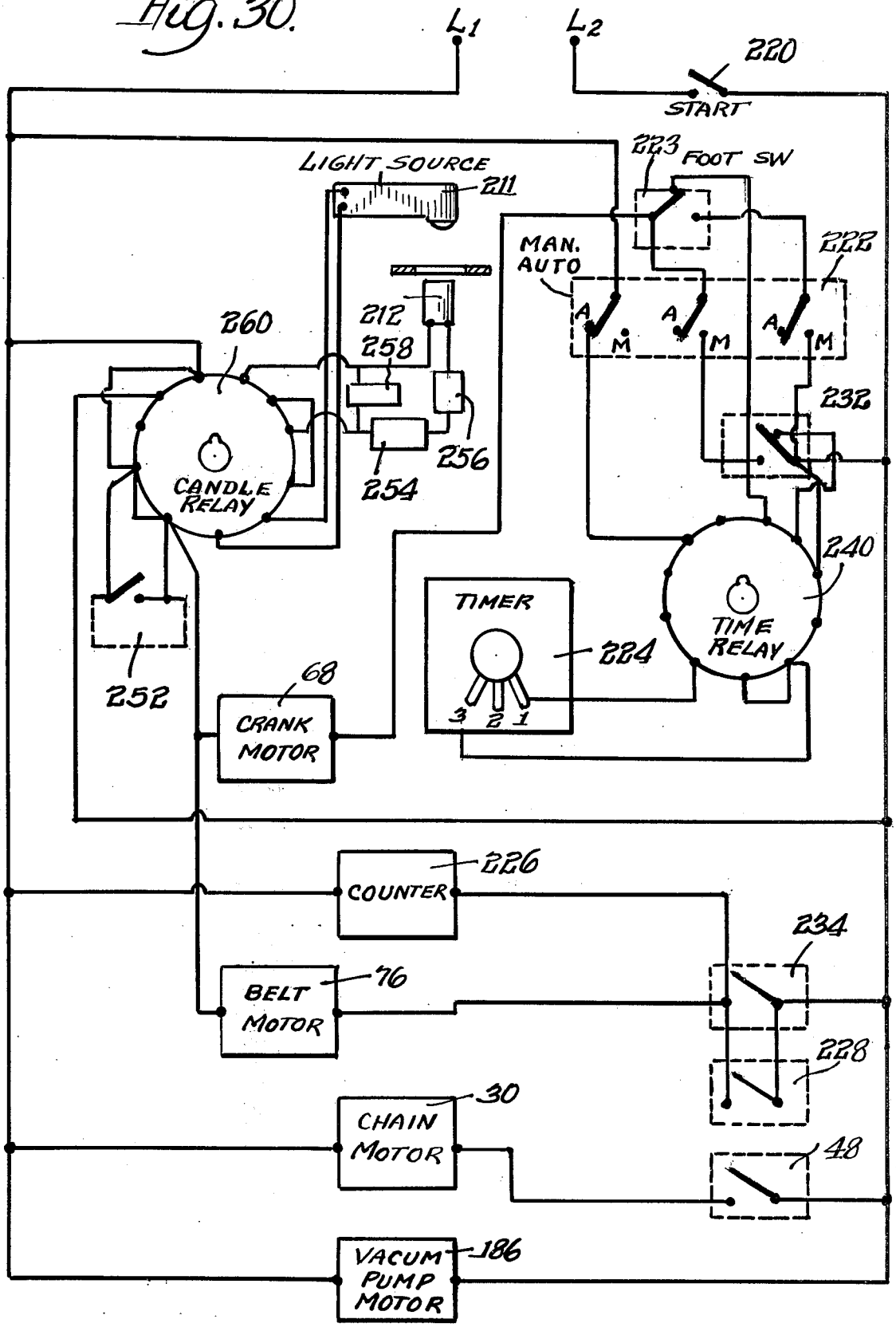
Figure 31:
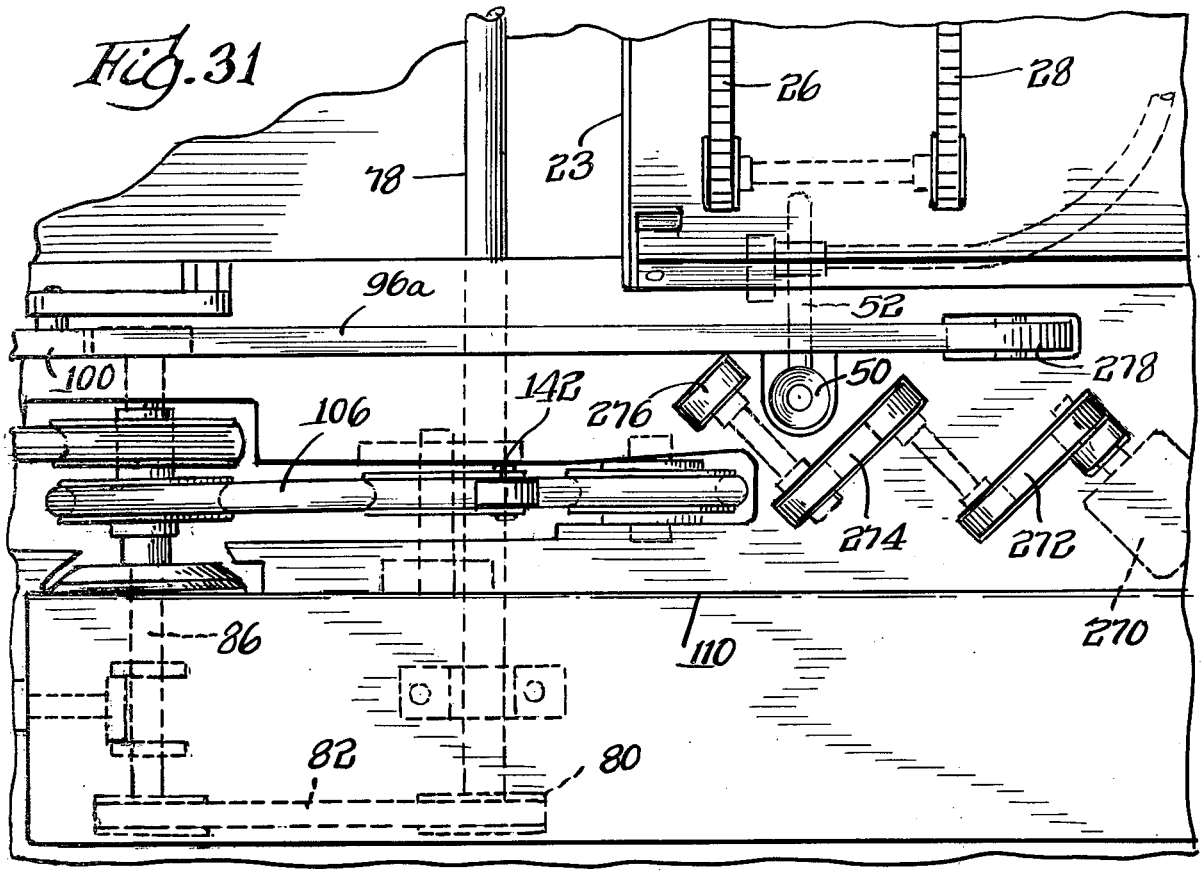
Figure 32:
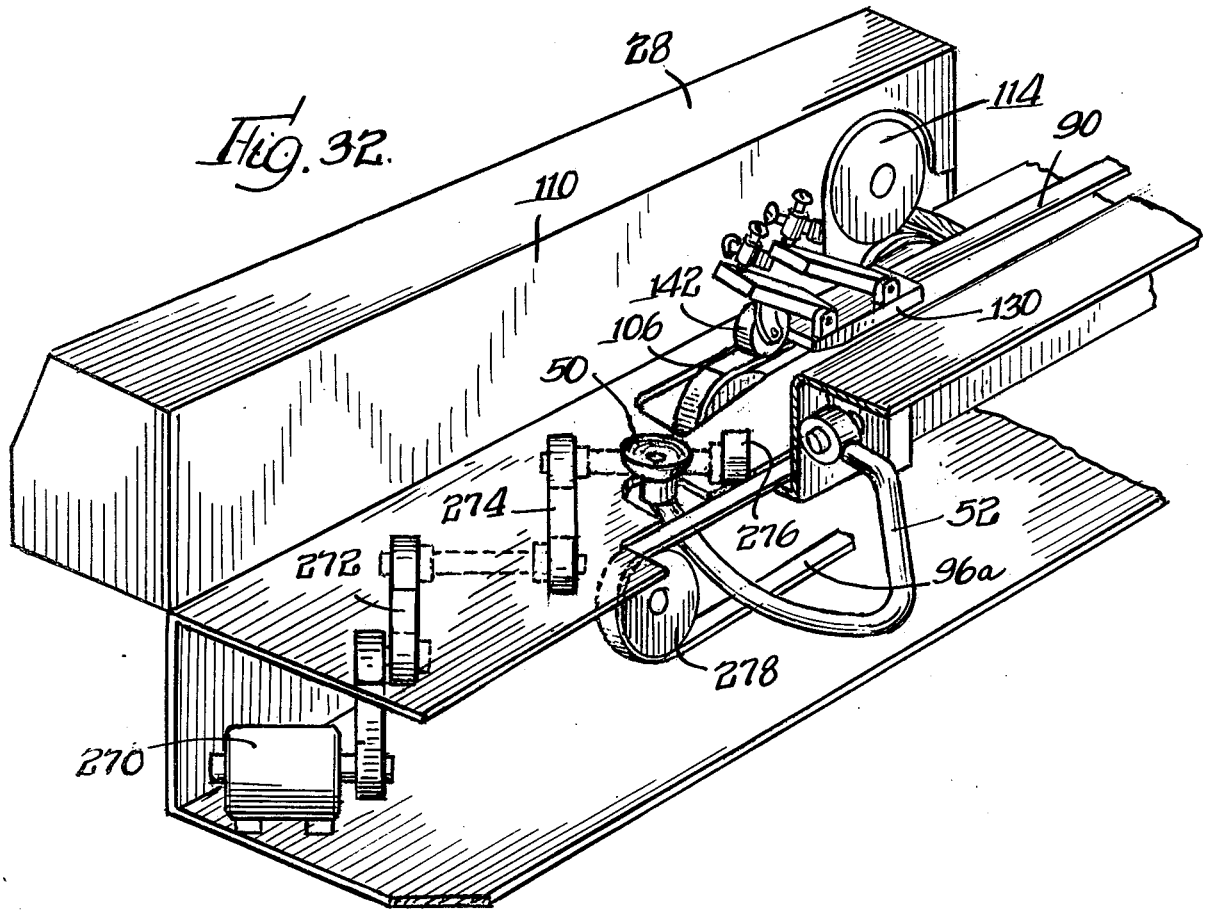
Figure 36:
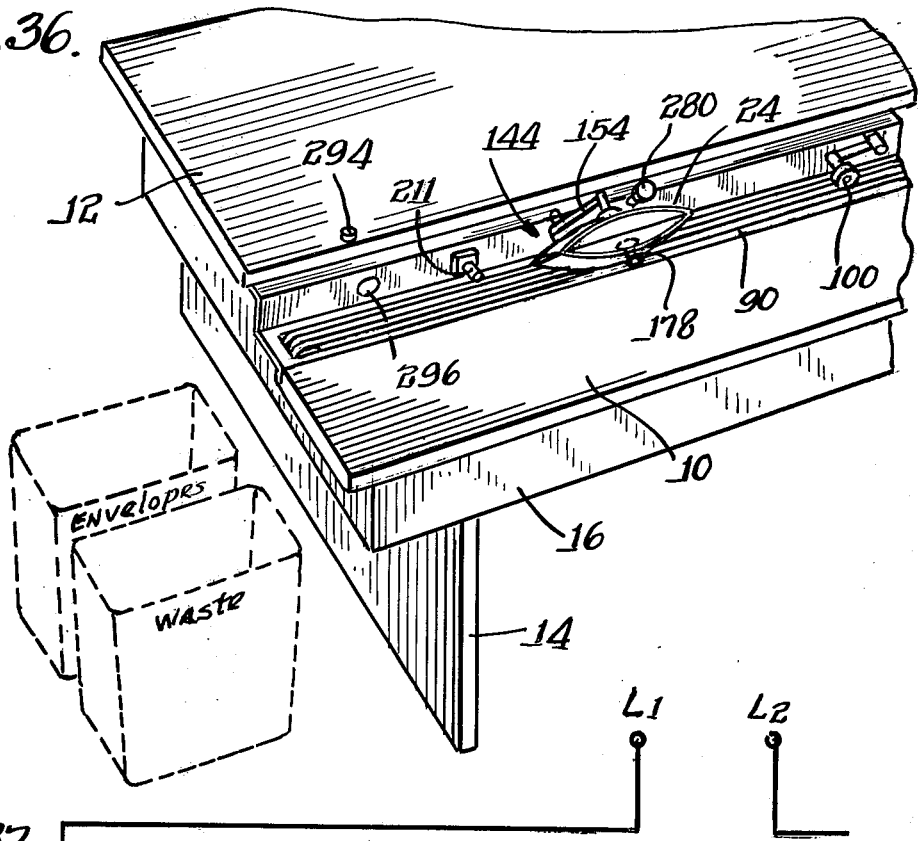
Figure 37:
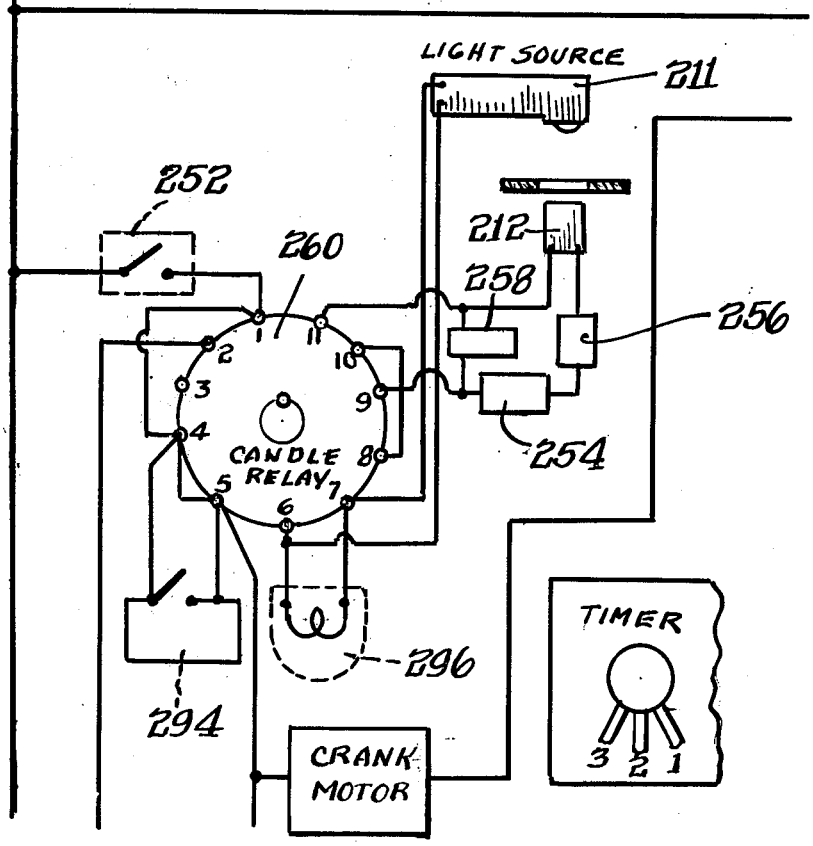
Figure 38:
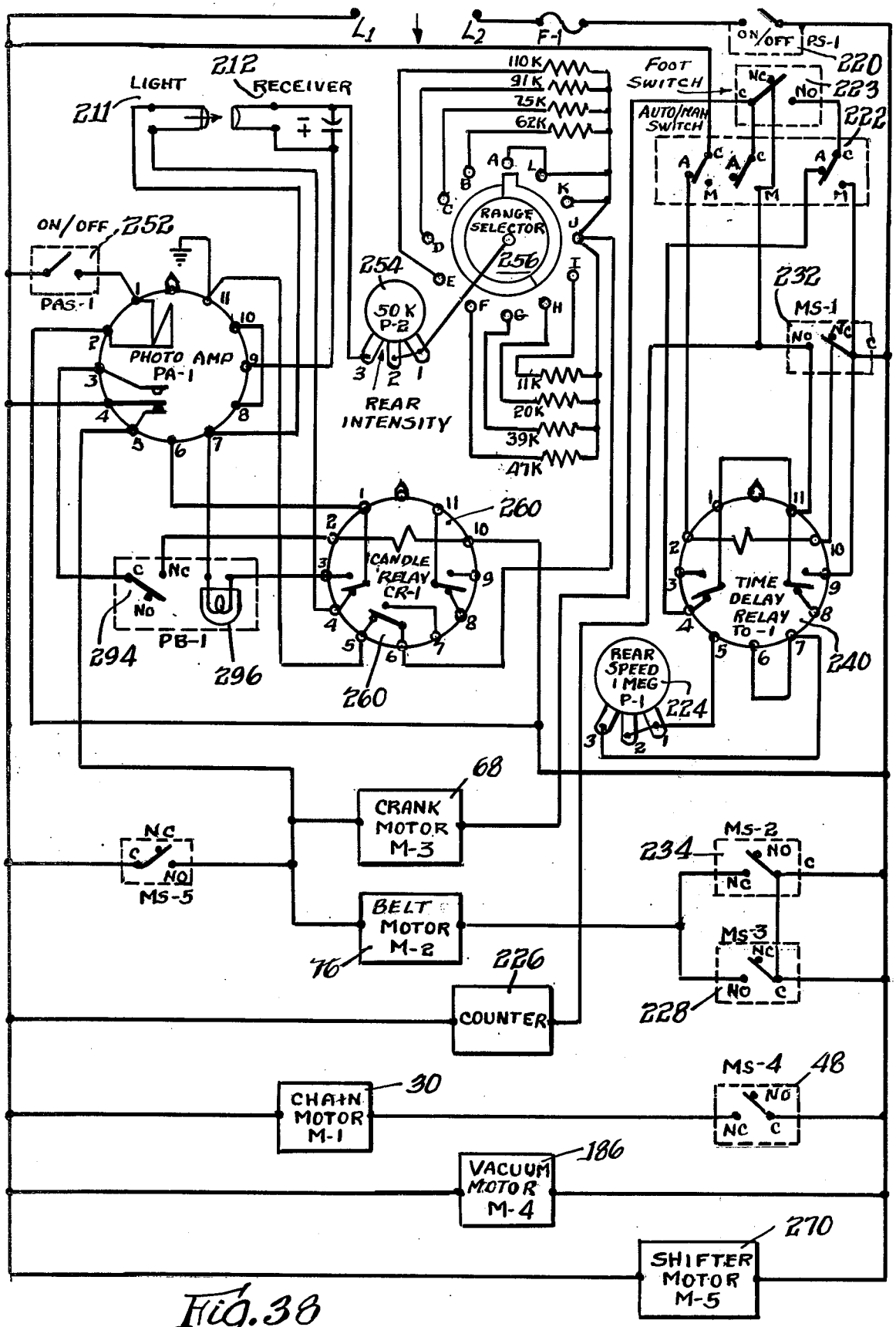

FIG. 21 is an enlarged detail view of the upper suction cup, forming a part of the envelope opening mechanism at the envelope processing station, the horizontal disposition of an envelope as it reaches the processing station also being shown;

FIG. 22 is a sectional view of the mechanism of FIG. 21, taken as indicated by the line 22—22 thereof;

FIG. 23 is a fragmentary view more particularly showing the attitude of the envelope at the processing station, for ready inspection and removal or insertion of contents;

FIGS. 24, 25 and 26 are detail views showing alternate forms of suction cups;

FIG. 27 is an illustrative view showing the manner of use of the cups of FIGS. 24, 25 and 26;

FIGS. 28 and 29 are views illustrating the manner in which a flapped envelope may be opened at the processing station, for the insertion of contents;

FIG. 30 is a schematic wiring diagram of the electrical circuits of the machine;

FIG. 31 is a partial plan view of a modified form of mechanism for transmitting envelopes from the supply hopper to the cutting station;

FIG. 32 is a perspective view of the mechanism shown in FIG. 31;

FIG. 33 is a view similar to FIG. 21 but illustrating a cup actuating mechanism of modified form;

FIG. 34 is a view of the mechanism of FIG. 33 as viewed from the right;

FIG. 35 is a partial view of the adjusting mechanism forming a part of the mechanism of FIGS. 33 and 34;

FIG. 36 is a partial perspective view, similar to FIG. 1, showing the modified cup actuating mechanism, and a modified form of candling mechanism;

FIG. 37 is a partial schematic wiring diagram for the modified candling mechanism; and FIG. 38 is a more detaled electrical schematic of the complete machine.

Referring more particularly to the drawings, and first to FIG. 1, the machine comprises lower and upper offset table structures 10 and 12, supported at table height by legs 14. The upper table 12 is hinged, as shown, and when closed covers the internal mechanism of the machine, and conveniently provides a work and table surface. As shown in FIG. 3, the operator sits facing the lower table structure 10, the front panel of the machine being indicated by the reference numeral 16. The supply hopper is shown to the right of the machine in FIGS. 1 and 2, and is generally indicated by the reference numeral 18. The electrical control panel is shown at 20.

Referring more particularly to FIGS. 5–8, the feed hopper comprises an inclined support table 22 upon which the envelopes to be processed, as indicated at 24, may be placed in suitably stacked relationship. In accordance with the machine of the invention, the envelopes to be processed either by filling or emptying may be of different length and height, such as letter size or business size, and envelopes of different size may be intermixed as may be desired. The supply hopper further includes a side abutment plate 23 against which the ends of the envelopes will be engaged.

Figures 5, 6, 7, 8:
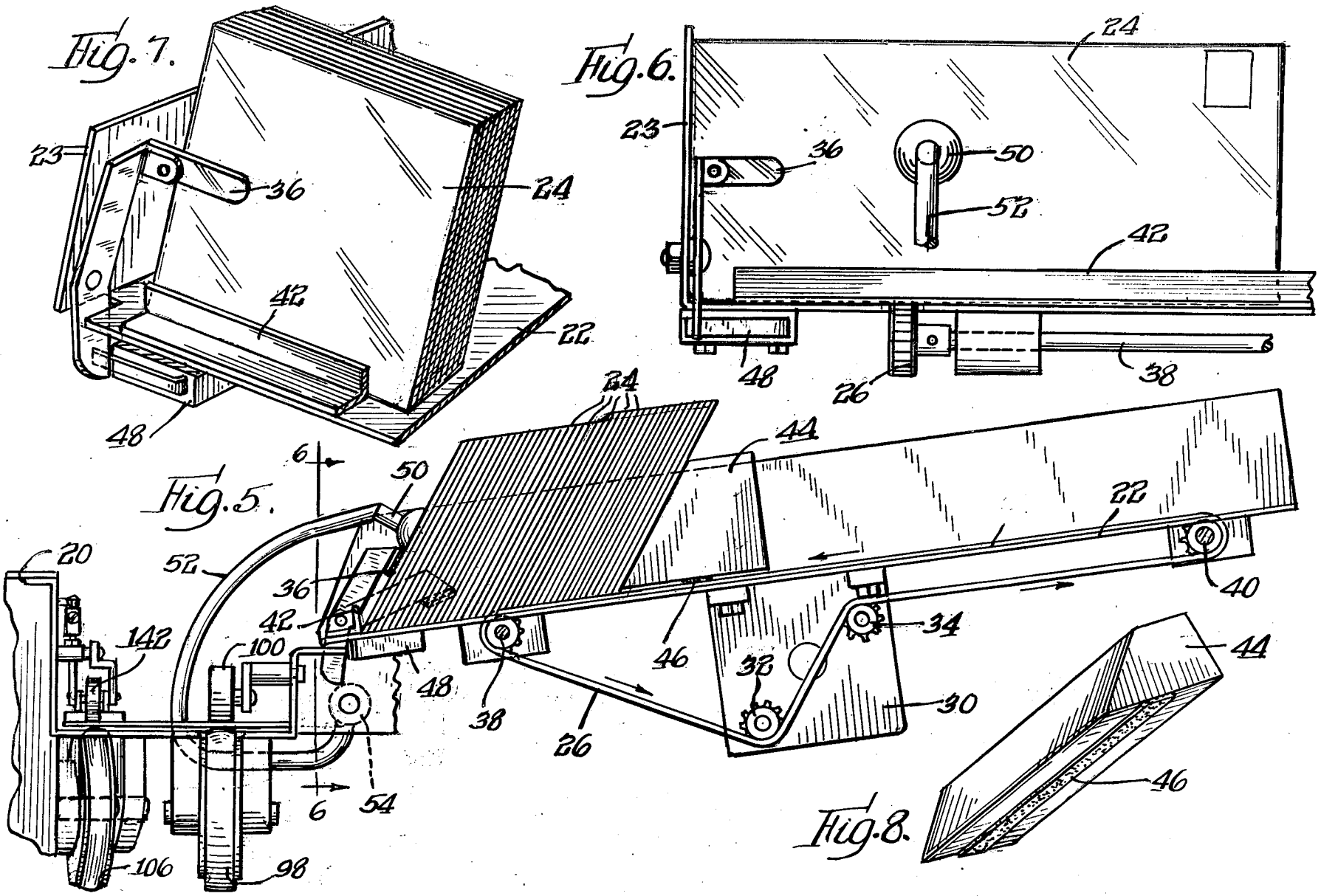
FIG. 5 is a detailed view of the hopper structure for the envelopes, and associated parts, taken as viewed from the right in FIG. 1.
FIG. 6 is a view of a part of the structure of FIG. 5, taken as indicated by the line 6—6 thereof.
FIG. 7 is an enlarged detail view of the switch structure forming a part of the hopper mechanism of FIGS. 5 and 6.
FIG. 8 is a perspective detail view of a wieght which may be used with the feed hopper.

Two feed chains 26 and 28, see also FIG. 1, are arranged for longitudinal travel along the length of the inclined support table 22, the chains being arranged to be driven, as may be required, by an electric drive motor 30, as illustrated in FIG. 5. More particularly, motor 30 is provided with a drive sprocket 32, there also being an idler sprocket 34, the arrangement being such that as the motor is actuated the chain 26 will be driven in the direction of the arrows as indicated at FIG. 5. Motor 30 is controlled from a switch arm 36, FIGS. 6 and 7, the arrangement being such that the stack of envelopes is constantly urged forwardly against the switch arm. If the supply of envelopes becomes deficient, the switch arm drops downwardly or to the right as seen in FIG. 5, toward its dotted line position, whereby to actuate the motor 30 and operate the drive chain 26 to bring the envelope supply back into switch arm engaging position to stop the motor. The sprocket shafts 38 and 40 for the chain 26, also form the sprocket shafts for the companion chain 28, FIG. 1, so that as chain 26 is driven by the electric motor 30, the chain 28 is simultaneously actuated. A stop 42 acts along with the switch arm 36 as a limit stop for the envelopes at their lower edges.

A boxlike weight 44, FIG. 8, having a strip 46 of felt or the like on its bottom, is arranged to lie upon and be supported by the inclined table 22, and to be driven by the chains 26 and 28, whereby to urge the envelopes forwardly in the hopper into engagement with the switch arm 36.

A switch 48, FIGS. 6 and 7, is operated by the switch arm 36, and may conveniently be a simple on and off switch, which, when operated by the switch arm, energizes and de-energizes the electric motor 30.

Figure 4:
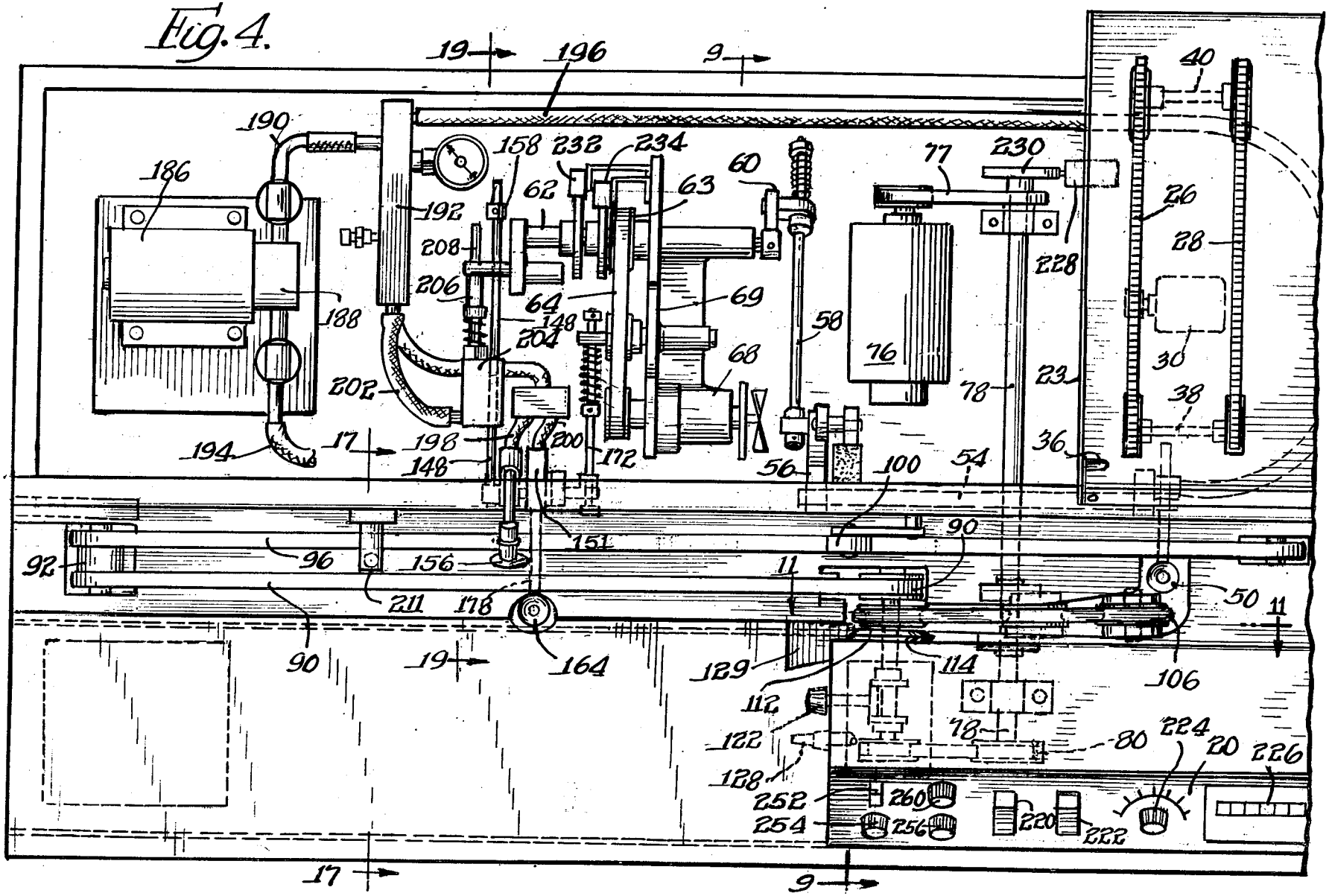
FIG. 4 is a top plan view of the machine, the upper table structure being removed to show the internal construction.

The envelopes are removed, one at a time, from the supply hopper by a suction cup 50, carried at the end of a tubular operating arm 52. As best shown in FIG. 5, arm 52 is of irregular shape and is connected to a pivot shaft 54, which as shown in FIGS. 4 and 15, extends transversely of the machine, the end of the shaft being connected to a link 56, shown in FIG. 4, and also in FIGS. 15 and 16.

Figure 15:
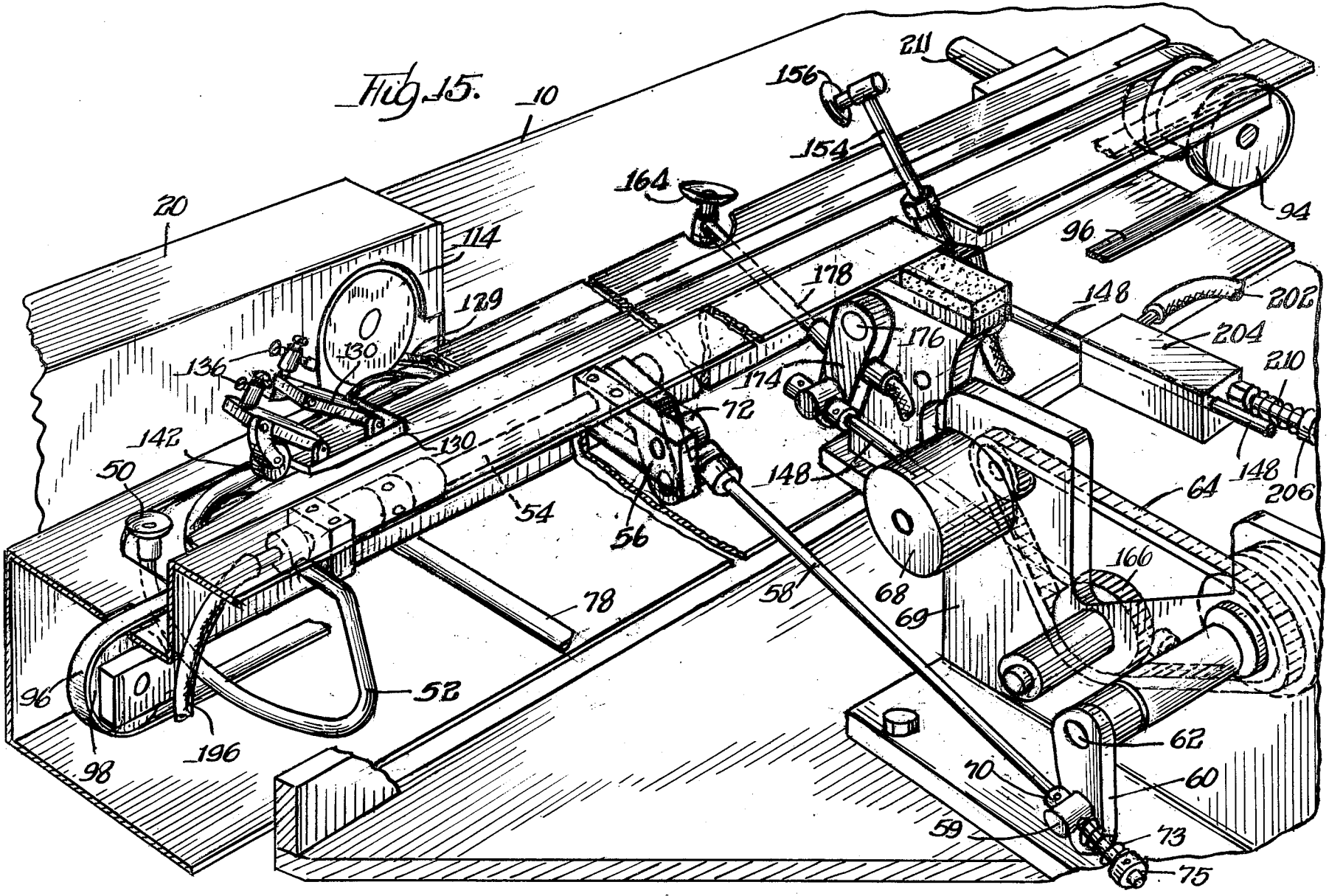
FIG. 15 is a perspective illustrative view showing the mechanism at the envelope opening and processing station.
Figures 16, 17, 18:
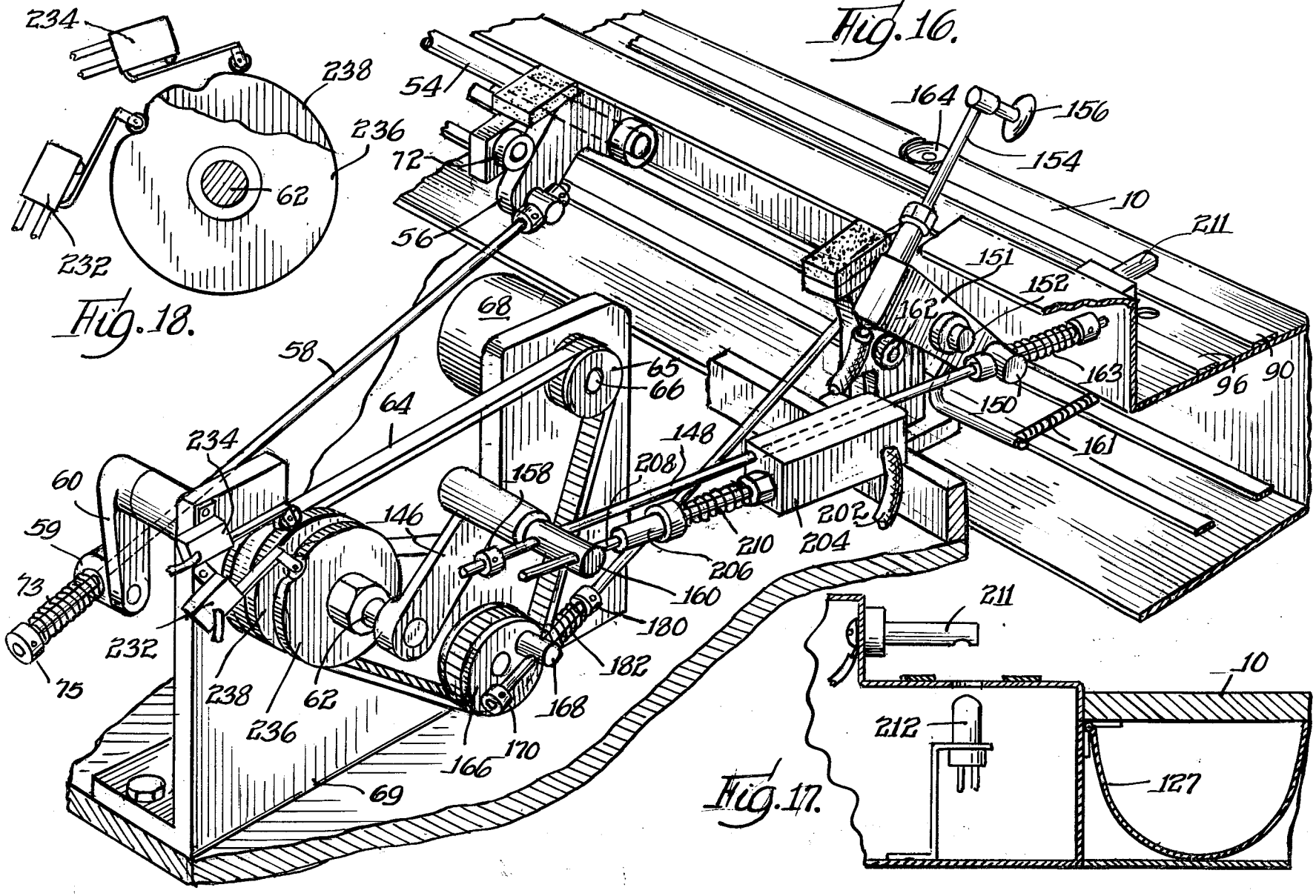
FIG. 16 is an illustrative perspective view, showing essentially the same mechanism as in FIG. 15, but looking from the opposite side.
FIG. 17 is a sectional view showing the detector mechanism, taken on the line 17—17 of FIG. 4.
FIG. 18 is a detail view of certain control switches, forming a part of the mechanism of FIG. 16.

The means for rocking shaft 54 is best shown in FIGS. 15 and 16. Link 56 is arranged to be actuated by a reciprocating rod 58 slidably mounted in a knob 59 carried by a crank 60 mounted on a rotatable shaft 52, as seen in FIGS. 15 and 16 and in FIG. 4. Shaft 62 is driven from a drive sprocket 63 carried thereby from a drive belt 64 which is in turn driven by a sprocket 65 carried by a shaft 66 driven from motor 68 as shown in FIG. 4. Shafts 62 and 66 are journaled in a support plate 69, as shown in FIGS. 4 and 15.

Figures 9, 10:
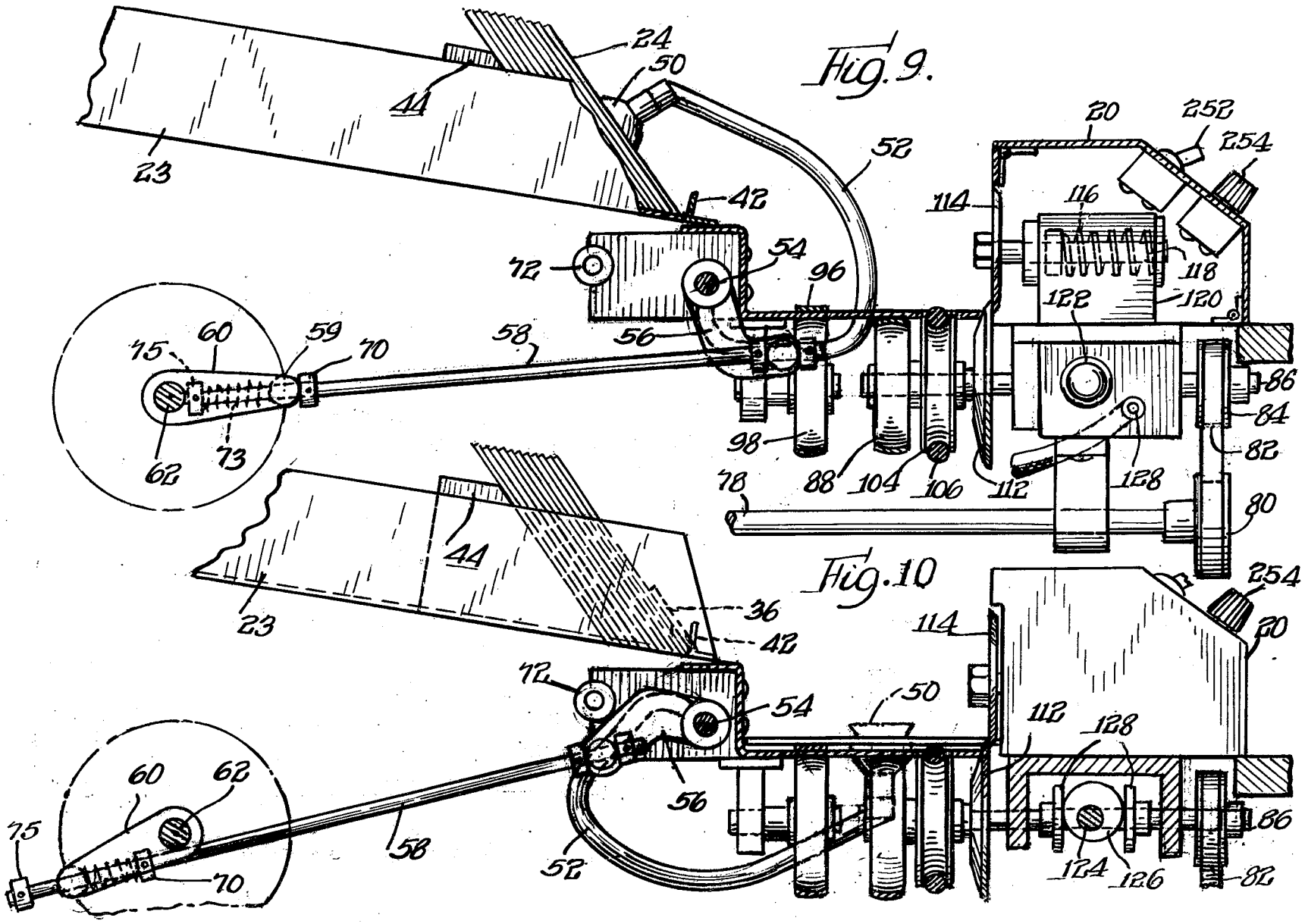
FIG. 9 is a detail illustrative view showing the feed hopper and associated cutting mechanism, and taken as indicated by the line 9—9 of FIG. 4.
FIG. 10 is a view of the mechanism of FIG. 9 in a second operationg position.

It will be seen that as motor 68 is operated, shaft 62 will be rotated to rotate crank 60 and reciprocate rod 58, which in turn reciprocates link 56 and rock shaft 54 between the end positions shown in FIGS. 9 and 10. The counterclockwise limit of motion of the rock shaft 54, as shown in FIG. 9, is controlled by engagement of knob 59 with adjustable collar 70, FIGS. 9 and 15, carried by the rod 58. The clockwise limit of motion of the rock shaft, as shown in FIG. 10, is controlled by an adjustable stop 72, as knob 59 compresses spring 73 against collar 75.

As will be presently described, vacuum is selectively applied to the suction cup 50, so that as rock shaft 54 is operated, the suction cup will remove an end envelope from the envelope stack within the hopper, as shown in FIG. 9, to flip the envelope past switch arm 36 and move the envelope into a horizontal position over feed belts to be transmitted to the cutting mechanism.

The means for transmitting a removed envelope from the feed hopper to the cutting mechanism will now be described.

Figure 13:
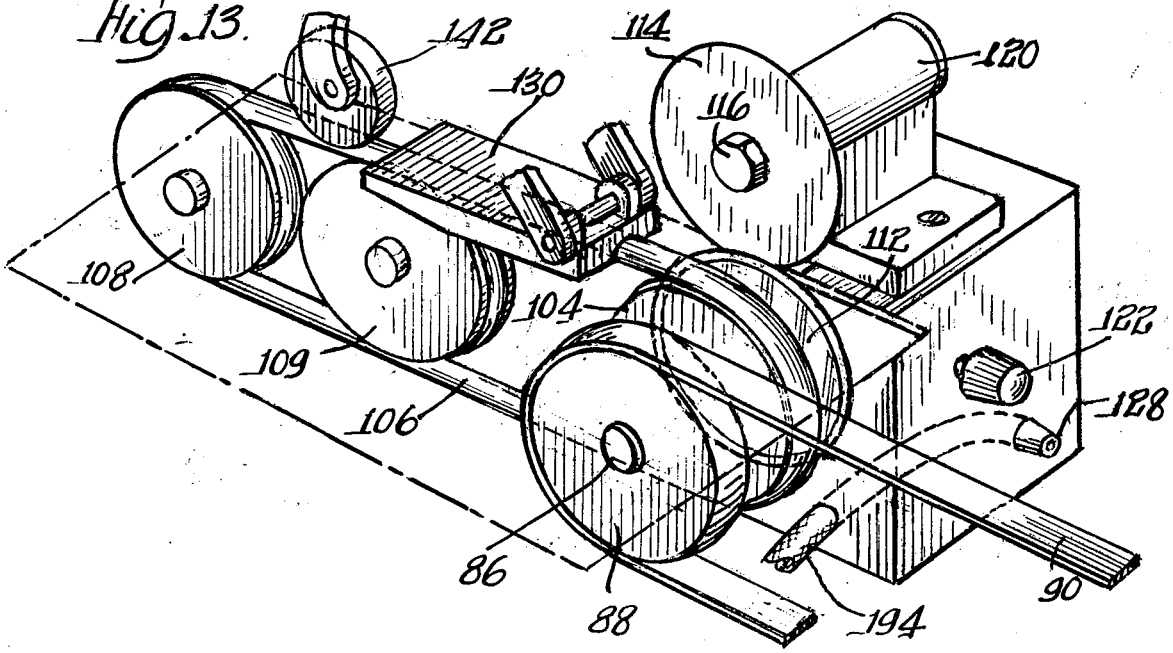
FIG. 13 is a perspective view of the same mechanism.
Figure 14:
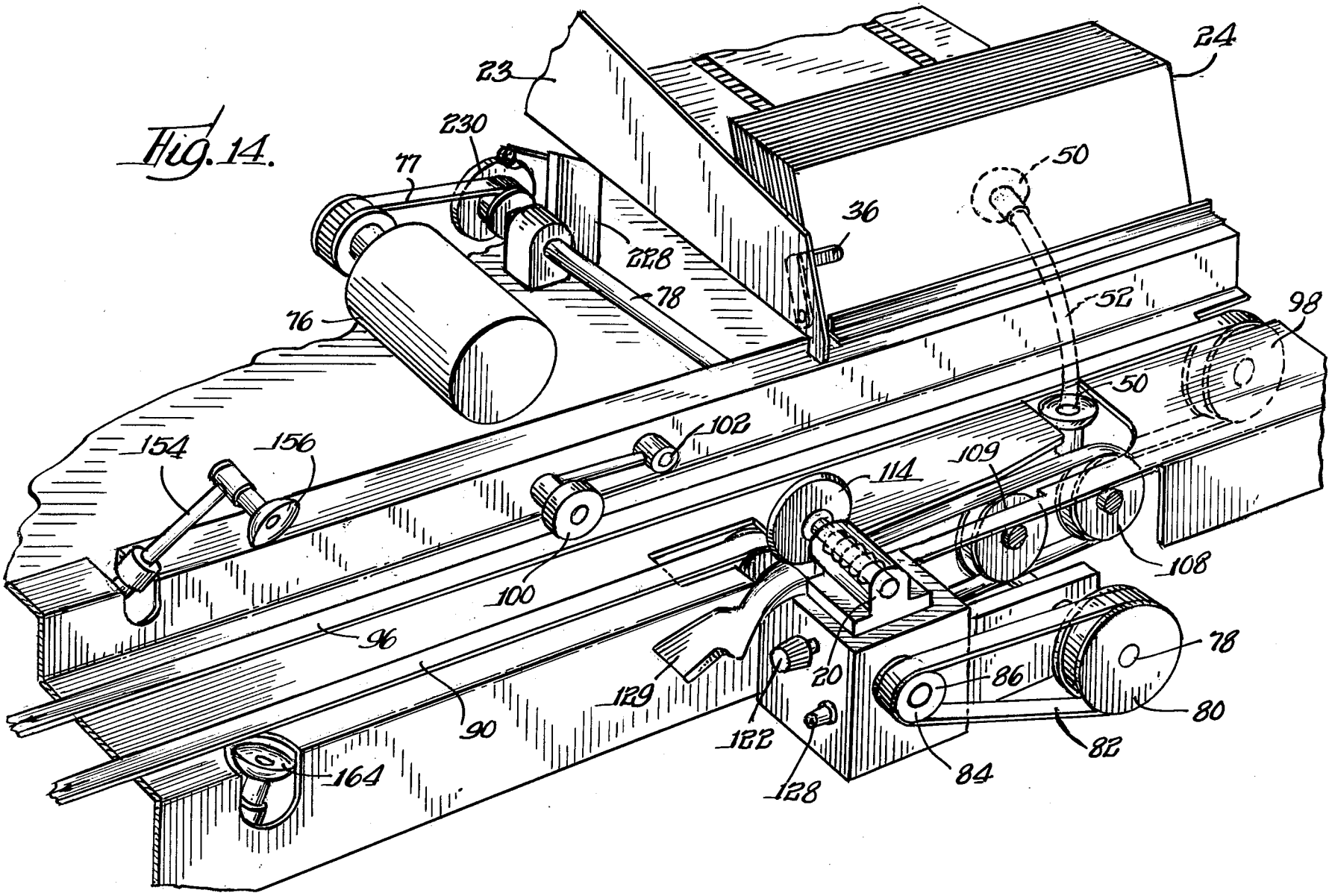
FIG. 14 is a perspective view showing the feed hopper, and the cutting station, and associated parts.

An electric drive motor 76, FIGS. 4 and 14, drives a belt 77, which in turn operates a drive shaft 78, the forward end of which carries a drive pulley 80, FIG. 14, arranged to drive a belt 82. Belt 82 drives a pulley 84 to thereby drive a shaft 86 which forms a part of the feed and cutting mechanism. As best shown in FIG. 13, the opposite or inner end of shaft 86 carries a pulley 88 which forms a drive pulley for one of the feed belts 90 arranged for longitudinal travel along the length of the lower table 10 of the machine. At the left end of the table, as seen in FIG. 4, the belt 90 passes over a pulley 92 mounted upon a shaft which carries a drive portion for the other feed belt 96 extending transversely of the machine and longitudinally of the table structure. As shown in FIG. 14, the opposite or right-hand end of the feed belt 96 passes over an idler pulley 98; and an idler roller 100, FIG. 14, rests upon and is driven by the feed belt 96, roller 100 being suitably mounted at the end of an arm carried on a pivot shaft 102. It will be seen that by reason of the connections provided, as electric motor 76 is operated to operate drive shaft 86, feed belts 90 and 96 will be simultaneously operated at predetermined speed, to the left or in the direction of the arrows shown in FIG. 14.

Drive shaft 86 carries a second pulley 104, FIG. 13, arranged to drive a feed belt 106 which engages pulley 104, and also a pair of idler pulleys 108 and 109, FIG. 13. As best shown in FIG. 12, feed belt 106 is angularly disposed in its longitudinal extension along the length of the feed table, so that as the envelopes are fed thereby, after release from the suction cup 50, the topmost edge of the envelope will be urged forwardly against the surface of a guide plate 110, FIGS. 11 and 12, forming a part of the table structure. To so direct the feed belt 106, pulley 108 and idler roll 109 are disposed at a desired angle, so that the feed belt thus provides an orienting means for the envelope against the guide plate as the envelope is conveyed. The proper position of the envelope as it reaches the cutting station is thus assured.

Drive shaft 86 further carries a rotatable cutting knife 112, as shown in FIGS. 9 and 14, forming a lower rotatable knife and cooperable with an upper idler rotatable knife 114, the two knives being cooperable to sever the top edge of the envelope engaged with and fed along the guide plate 110, FIG. 10. Knife 114, FIGS. 9 and 14, is mounted upon a rotatable shaft 116, there being a compression spring 118 surrounding the shaft within its mounting housing 120, and arranged to urge the upper knife 114 into face engagement with the lower driven rotatable knife 112. Preferably housing 120 and shaft 86 are so positioned that knives 112 and 114 are angularly disposed in the same manner as belt 106, but at a lesser angle.

Means is provided for longitudinally adjusting the drive shaft 86, FIG. 10, to thereby position pulley 104 and knife 112 in respect to the guide plate 110, FIG. 12, and the top of the envelope to be severed. This adjustment means comprises an adjustment knob 122, FIG. 9, mounted on one end of a shaft 124, the other end of which carries a cam 126, FIG. 10, engageable between a pair of collars 128 carried by the shaft 86, whereby upon rotation of knob 122, drive shaft 86 is longitudinally adjusted to position the cooperable rotatable knives. In FIGS. 9 and 10 the knives are shown projected to provide a substantial cut. The knives may be withdrawn upwardly, as seen in FIG. 12, to lessen the cut, or eliminate it entirely upon withdrawal past plate 110.

In summary of the mechanism described above, it will be seen that as drive motor 74 is operated, drive belts 90, 96 and 106 will be simultaneously operated. Thus, as the envelope is deposited upon belts 96 and 106 by the suction cup 50, upon actuation of the belts the envelope will be driven to the left, as seen in FIGS. 1 and 14, being urged by belt 106 into engagement with and held against the guide plate 110, and the top edge of the envelope being severed by the knives 112 and 114; or, alternatively, the knives may be rendered inoperative by adjustment. The severed envelope scrap edge, when the knives are used, is transmitted to a reservoir 127, FIG. 2, by a guide member 129, FIGS. 2 and 14. Table 10 may be hinged upwardly for access to reservoir 127. An air jet 128 projects knife scrap longitudinally of the reservoir, into a receptacle suitably positioned at the left end of the machine, FIG. 1.

Figure 11:
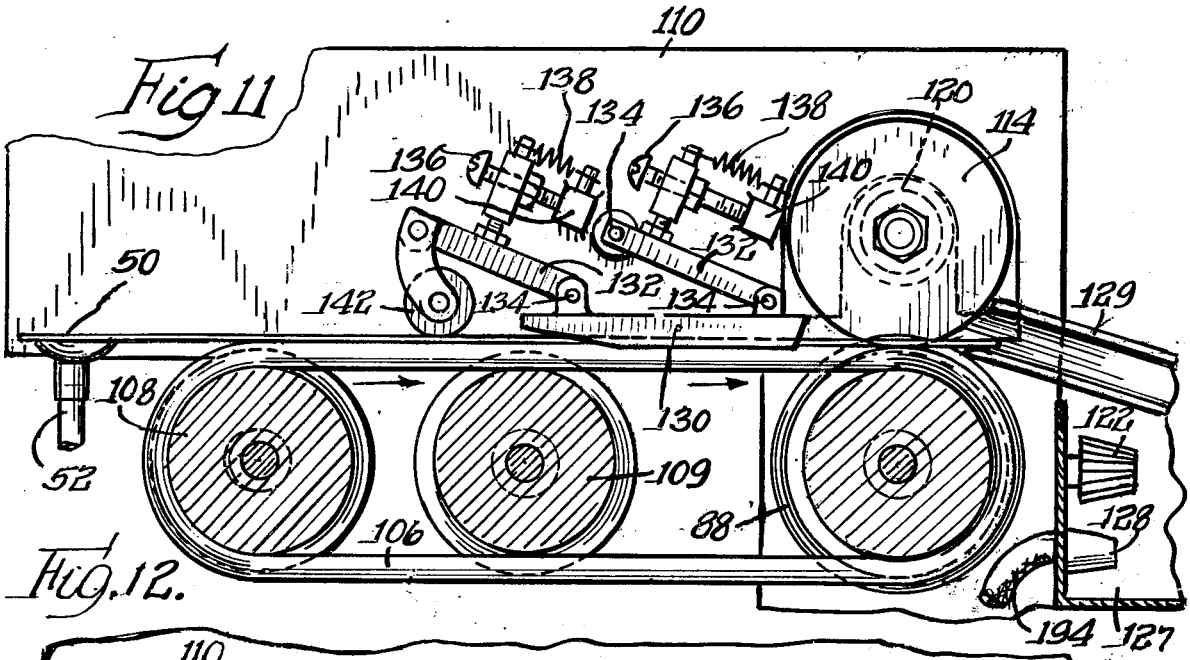
FIG. 11 is a detail illustrative view more particularly showing the feeding means for transmitting the envelopes from the hopper to the cutting station, taken as indicated by the line 11—11 of FIG. 4.
Figure 12:
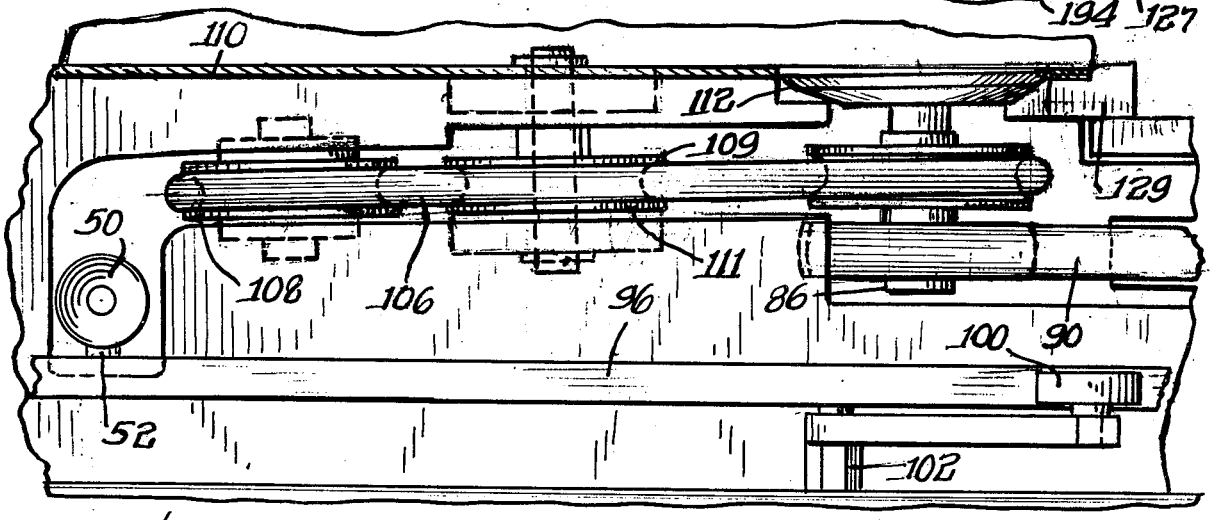
FIG. 12 is a top view of the mechanism shown in FIG. 11.

To further properly guide the envelope in its transmission to the cutting knives, guide means engageable with the face of the envelope is provided, as best shown in FIGS. 11 and 13. Grooved shoe 130 riding on belt 106 is carried by a pair of arms 132, mounted on pivots 134, the pivotal position of the arms being controlled by adjustment screws 136 carried by upstanding projections on arms 132, and tension springs 138, connected to the projections and anchored to fixed abutments 140. A roller 142 also rides on belt 109 in advance of the guide shoe, so that the envelopes will be properly transmitted by belt 106 to the cutting knives, even though the surfaces thereof may be creased or bent.

Operation of the drive belts 90 and 96 transmits the envelopes through the cutting station, under the guide roller 100, FIG. 1, and to the envelope opening and processing station which will now be described.

The opening and processing station is generally indicated by the reference numeral 144 in FIG. 1. The envelopes are transmitted to the processing station in a flat or horizontal attitude, FIG. 24, and as an envelope reaches the processing station, belts 90 and 96 are automatically stopped by means presently to be described.

Referring to FIG. 4 and FIGS. 15–16, rotatable shaft 62 previously described, carries a crank 146, FIG. 15, arranged to operate a rod 148, the forward end of which is connected to knob or boss 150 of a crank 151 secured to pivot shaft 152. Crank 151 carries an arm 154 to the end of which is secured an upper envelope-opening suction cup 156. Rod 148 is slidably carried in an abutment knob 160 secured to crank 146, and carries an adjustment collar 158 engaged by the abutment knob, the arrangement being such that once during each operation of the crank, collar 158 is engaged by knob or boss 160 to pull rod 148 rearwardly, and lower suction cup 156 from its upper position shown in FIGS. 15, 16 and 19 to a lower position as shown in FIG. 20, for engagement with an envelope disposed at the processing station. Position of collar 158 determines the limit of clockwise travel of the suction cup support arm 154. A return spring 161, FIGS. 16 and 19, normally restores the suction cup upwardly or in a counterclockwise direction against a stop 162, during the time that the collar 158 is not engaged. It will be seen that by means of the foregoing, the upper suction cup 156 is operated in timed relation between its FIG. 19 and 20 positions in the operation of the machine. A safety spring 163 operates in the event the cup strikes an obstruction during its lowering movement.

The processing station further provides a lower cooperable suction cup 164, cooperable with the upper cup 156 to open and hold open the envelope at the processing station. To this end, drive belt 64, previously described, is trained over and operates a pulley 166, FIGS. 16 and 19, provided with a projecting abutment knob 168 arranged to engage an adjustable collar 170 on a rod 172 slidably carried by knob 168, the forward end of the rod being secured to a crank 174, FIG. 15, operable upon a pivot shaft 176. Crank 174 carries an arm 178 carrying the suction cup 164. Rod 172 further carries an adjustable collar 180, FIG. 16, there being a compression spring 182 mounted on the rod between collar 180 and the abutment knob 168.

It will be seen that by means of the connections provided, as the pulley 166 is rotated, abutment knob 168 engages collar 170, once at each revolution, to move the suction cup 164 downwardly or clockwise to its FIG. 19*a* position. Continued rotation of pulley 166 causes the abutment knob 168 to compress spring 182 so as to move the lower suction cup upwardly or counterclockwise to its FIG. 19 position against a limit stop 184, FIG. 19.

Means is provided for transmitting vacuum, or negative pressure, to the suction cups 50, 156 and 164 in timed relation in the operation of the machine.

Referring to FIG. 4, a motor 186 is provided, continuously operable during operation of the machine, which drives a vacuum pump 188 whereby to supply suction to line 190 connected to a distributor block 192. Air is exhausted from the vacuum pump through exhaust line 194 leading to the exhaust jet 128.

A conduit 196 interconnects distributor 192 with the suction cup 50, and similarly conduits 198 and 200 interconnect the block 192 with the upper and lower envelope-opening suction cups 156 and 164, respectively.

A further conduit 202 interconnects distributor block 192 with a dump valve 204 carried by rod 148, FIGS. 4 and 15, the arrangement being such that the dump valve breaks the vacuum to the suction cups, in timed relation, in the operation of the machine. More particularly, as shown in FIG. 16, abutment knob 160 is arranged to actuate a collar 206 adjustably secured to rod 208 slidably carried in the knob, whereby to actuate the rod forwardly as seen in FIG. 16, to break the vacuum within the vacuum system during such time as the rod is so actuated. The compression spring 210 restores the rod rearwardly to restore vacuum, except during such time as the abutment knob 160 engages the adjustable collar 206.

The machine further includes a detector or candling mechanism comprising a light source 211, FIGS. 1, 4 and 17, and a photocell 212, operable at a detector station generally indicated by the reference numeral 213, FIG. 1, to detect the presence or absence of contents within an envelope. The operation of the candling or detector mechanism will be further described in connection with the operation of the composite machine.

The operation of the machine will now be described, reference being made to the schematic wiring diagram, FIG. 30.

Referring to FIGS. 1 and 30, the electrical controls comprise a main on/off switch 220; a manual foot switch 223 for single cycle operation; a manual-/automatic selector switch 222; a timer control 224 for adjusting the cycle speed of the machine in automatic operation; and there is further provided a counter 226.

Associated with the belt drive motor 76 is a control switch 228, FIG. 14, adapted for actuation by a cam 230 secured to shaft 278. Associated with the crank motor 68 are two switches 232 and 234, FIG. 16, adapted for operation respectively by cams 236 and 238, secured to shaft 62.

Referring to FIG. 30, closing of the one/off switch 220 sets the vacuum pump motor 186 into operation continuously for as long as the switch remains closed. The chain motor 30 will also be energized, whenever and for as long as its control switch 48 is closed.

To operate the machine manually in single cycles, switch 222 is actuated to "Manual" position. Momentary operation of foot switch 223 then starts crank motor 68. As motor 68 is energized, switch 234 operates to energize the belt-drive motor 76. Operation of the belt motor causes closing of switch 228 to establish a holding circuit for one complete operation of the belt motor. Operation of the crank motor 68 also closes switch 232 to establish a holding circuit for one complete operation of the crank motor. Operation of switch 234 also causes actuation of the electrical counter 226 to record the machine cycle of operation.

If foot switch 223 is held depressed, the machine will continue a succession of manual cycles.

To set the machine into automatic operation, switch 222 is moved to "Automatic" position. This energizes the time-delay relay 240, FIG. 30. Automatic cycling of the machine thereupon is initiated, at a speed between cycles determined by the setting of timer switch 224.

During automatic operation, if foot switch 223 is actuated, the crank motor 68 will be stopped, but belt motor 76 will continue it operation to complete a cycle. Upon release of foot switch 214, automatic operation of the machine is resumed.

Upon each cycle of operation as above described, cup 50 drops from its dotted-line to its dotted-line to its lowermost position, as seen in FIG. 10, and suction is released by dump valve 204 to thereby deposit an envelope on the feed belts. Immediately thereafter, the feed belts operate to feed the envelope through the cutting knives to proper position at the processing station 144, and the belts then stop. As the cycle is initiated, lower suction cup 164 at the processing station moves from its upper position of FIG. 19 to its lower position of FIG. 19*a* to receive an oncoming envelope at the processing station, and suction is released so that the previously processed envelope is released and the feed belts remove the previously processed envelope to the left as seen in FIG. 1.

As the cycle progresses, lower suction cup 164 is raised and upper suction cup 156 is lowered, and suction is applied to grip an initially horizontally disposed envelope as seen in FIG. 20, and thereafter both cups are raised to open and hold open the envelope as seen in FIG. 20, until a new cycle is initiated, for a dwell time determined by the setting of the timer in automatic operation. During the machine cycle, cup 50 is raised, and suction is applied to remove an envelope from the hopper and move it to the hold position first described.

An important feature of the invention is the orienting means by which an envelope is accurately positioned as it engages the cutting knives. A further important feature of the invention is the attitude and position to which the envelope is brought by the opening suction cups. As shown in FIG. 20, the envelope arrives at the processing station in a substantially horizontal position. At the processing station it is lifted by the suction cups 156 and 164, and opened, and maintained in an attitude of an acute angle of approximately thirty degrees to the horizontal, as seen in FIG. 19. In this position, the open envelope may be readily inspected by the operator, and the contents removed. More particularly, referring to FIG. 3, it will be seen that the envelope, in opened position at the processing station, is so disposed that the interior of the envelope may be readily inspected by the operator, without strain or movement. The interior of the envelope is also fully accessible, for removal or insertion of contents. When the machine is being used for removal of contents from the envelope, it may happen that the contents tend to adhere to the envelope wall, and this tendency may be augmented by air-bleed through the envelope wall by the action of the suction cups. However, due to the attitude and dispostion of the envelope at the processing station, both walls thereof are accessible both exteriorly and interiorly, so that the operator may grip an envelope wall with her fingers for ready removal of the contents.

The control timer 224 is adjustable so that the dwell time between cycles, during which time the envelope is held at the processing station in open position, may be adjusted and controlled. As the machine recycles, the envelope from the processing station is transmitted to the left as seen in FIG. 1, and a new envelope is brought into position at the processing station.

The timing of the lower suction cup 164 is such that the envelope is released at the processing station onto the transfer belts 90 and 96 after the belts have moved a predetermined distance, so that at the end of the belt movement the envelope will be disposed at a recovery station indicated by the reference numeral 250 in FIG. 1. At the recovery station the envelope may be retrieved by the operator, or permitted to drop into the envelope receptacle upon a subsequent operation of the machine, as the occasion may require.

It will be seen that the machine may be used for removing contents fron envelopes, or for filling envelopes at the processing station, and that the envelopes may be intermixed as to size in the supply hopper. When contents are to be removed from sealed envelopes, the cutting mechanism will be used; but if the envelopes are precut, or if unsealed envelopes are used and the machine is to be used for filling such envelopes, then the knives of the cutting mechanism will be withdrawn sufficiently so as to be inoperative.

The candling mechanism normally is employed when the machine is used for emptying envelopes, and will be so described.

Referring to FIG. 30, the candling mechanism, in addition to the light source 211 and the photocell or receiver 212, includes an on-off switch 252, a primary variable resistor 254, a secondary variable resistor 256, a variable capacitor 258, and a candle mechanism relay 260.

When the light reaching the photocell receiver 212 from the light source 211 drops below a predetermined intensity, as for example when contents from an envelope have been overlooked or otherwise not removed, the increased resistance thereby introduced into the control circuit by the receiver 212 cuts off the power supply and immediately stops the machine, and the machine remains stopped for so long as such condition exists. To vary the critical control resistance, to accommodate for envelopes of different thickness and character of paper, a primary variable resistor 254 for providing major adjustment, and a secondary variable resistor 256 for providing secondary or micrometer adjustment are provided. Also, so that the machine will not be stopped as the double thickness but relatively narrow seams of the envelope pass the receiver, the variable capacitor 258 is provided, so that the transitory fluctuation due to such envelopes seams will not interrupt the operation of the machine.

FIGS. 21 and 22 are detail views, more particularly showing the mounting means for the upper suction cup 156, at the processing station, and the manner in which arm removal may be effected so that different upper suction cup arrangements may be employed.

Referring to FIG. 21, it will be seen that the arm 154 for the upper suction cup 156 is removably held within its support socket 262 by means of a threaded nut 264, so that upon removal of the nut, upper suction cups of different character and arrangement may be substituted. In FIG. 21, a suction cup 156*a* carried by a shorter support arm is shown in dotted lines, for illustrative purposes.

FIG. 23 shows the envelope 24 as opened by the primarily described suction cups 156 and 164.

FIGS. 24, 25 and 26 are illustrative views, showing different forms of upper suction cups; and FIG. 27 is an illustrative view showing the manner in which the station cups of FIGS. 24, 25 and 26 may be brought into contact with an envelope to be opened.

FIGS. 28 and 29 are illustrative views showing the manner in which a flapped envelope may be opened for filling. The upper and lower suction cups in this instance are illustrated at 156*e* and 164*e* respectively, and the envelope 24*a* is shown with its sealing flap 266. It will be seen that as the suction cups are expanded, the flap of the envelope will be pulled open so that the envelope at the processing station may be filled, with the contents to be inserted. As shown particularly in FIG. 21, stop 162 is eccentrically mounted, and adjustable, to adjust the uppermost travel of the upper suction cup.

With some envelopes, more positive means may be desired for shifting the envelopes into engagement with the guide plate 110, in their transmission from the supply hopper to the cutting station. Such an arrangement is illustrated in FIGS. 31 and 32.

An electric motor 270 is provided, operable continuously while the machine is in operation, which through suitable drive connections operates shifter belts 272 and 274, and a roller 276, operable to shift the envelope on an approximately 45° angle toward the guide plate 110, and also longitudinally thereof toward the cutting station. Belts 272 and 274 and roller 276, being constantly operable, function to move the envelope against the guide plate 110 and toward the cutting station, immediately upon release of the envelope by the suction cup 50. The envelope will move toward the cutting station until the forward edge thereof abuts the lower surface of the roller surface of the roller 142 which overlies the feed belt 106. By this means, the forward edge of the envelope is accurately positioned, so that it begins its movement toward the cutting station, immediately as feed belt 106 and roller 142 start to operate. As shown in FIGS. 31 and 32, the main feed belt **96*a*, corresponding to feed belt 96 previously described, is in this instance shortened to accommodate the constantly operable feed devices above-described. Feed belt 96*a* is trained over an idler pulley 278, similar in function to the idler pulley 98 previously described. The mechanism as shown in FIGS. 31 and 32** permits a wide range in size of envelopes processed by the machine.

In FIGS. 33–36, a modified arrangement is illustrated for adjusting the opening gap of the envelope at the processing station. The adjustment means in this instance being conveniently operable from the outside of the machine, at the processing station. In institutional use, for example, it may be desirable to have the envelope contents as large as possible in relation to envelope size, for maximum economy, while at the same time effecting a maximum opening of the envelope at the processing station, for efficacy of operation. With maximum size contents, if the envelope is opened too wide, the contents will bind. On the other hand, maximum opening without binding is desirable. Thus, ready adjustment of the opening gap at the processing station, conveniently operable by the operator, is desirable.

Referring to FIGS. 33–35, in the mechanism shown, the lower suction cup 164 and the means for operating it may be as previously described. However, adjustment means operable externally of the machine at the processing station, is provided for adjusting the upper travel limit of the upper suction cup 156. More particularly, there is provided an adjustment knob 280 secured to a shaft 282 threadedly received within a support bracket 284 forming a part of the frame structure of the machine. A coil compression spring 286, encompassing the shaft, provides a predetermined resistance to shaft rotation. The lower end of shaft 282 carries a collar 288, adapted to be adjustably positioned upon the shaft by means of a set screw 290. The upper face of collar 288 carries a rubber bumper 292 which forms an abutment for crank arm **151*a* corresponding to crank arm 151 in the embodiment previously described. It will be seen that by rotational adjustment of knob 280, rubber bumper 292 will be variably positioned to variably adjust the limit of counterclockwise movement of arm 151*a*, to thereby variably adjust the upper limit of travel of the suction cup support arm 154 and suction cup 156**.

The adjustment knob 280, as best shown in FIG. 36, is in a convenient location at the processing station for ready manipulation by the operator. Adjustment may be made while the machine continues to operate, so that the opening of the envelope can be accurately correlated with the size of the envelope contents. The lines to all suction cups are sufficiently small so that the operation of one does not materially affect the others.

FIG. 36, and the partial wiring diagram FIG. 37, also show an alternate for the candling mechanism. In the embodiment previously described, the machine is stopped immediately upon detection of an improper envelope content. However, in some instances, it may be more desirable to permit the machine to continue the cycle of operation in which it is engaged, until the end of the cycle, and then stop, with a suitable indication to the operator, after which the improper envelope may be retrieved and the cycling of the machine may then be continued.

Referring to the partial wiring diagram, FIG. 37, illustrating the portion of the circuit for the candling mechanism, the OFF/ON switch 252 has been relocated, and there is additionally provided a reset switch 294 and an indicator light 296. If an envelope reaches the candling station from which the contents have not been properly removed, the increased resistance introduced into the control circuit, as previously described, turns on the indicator light 296, and the machine stops after completion of its cycle. The improperly emptied envelope may then be retrieved whereupon reset switch 294 is actuated to turn off the indicator light 296, and restore operation of the machine. As shown in FIG. 36, the reset switch 294 and indicator light 296 are accessible to the operator at the processing station, for ready manipulation.

FIG. 38 is a complete wiring diagram for the machine, for the embodiment last described including the structures described with reference to FIGS. 31 and 37. The complete wiring diagram will be clear from the descriptions heretofore given with respect to FIGS. 30 and 37.

It is obvious that various changes may be made in the embodiments set forth for purposes of illustration without departure from the spirit of the invention.

The invention is hereby claimed as follows:

1. An envelope processing machine comprising a supply hopper for envelopes, cutting means for severing one edge of an envelope, means for removing envelopes in one by one relationship from the supply hopper and for transmitting the removed envelopes in substantially horizontal disposition to the cutting means, means for transmitting the envelopes from the cutting means in substantially horizontal disposition to an envelope processing station, and envelope opening means comprising a pair of suction cups operable upon opposing faces of the envelope at said envelope processing station for opening an envelope by moving each side thereof upwardly from horizontal position and holding it open for manual removal of envelope contents.

2. An envelope processing machine as defined in claim 1 wherein means is provided for adjusting the predetermined time interval during which the envelope is held open at the processing station.

3. An envelope processing machine as defined in claim 2 wherein said adjustment means comprises an adjustable electric timer.

4. An envelope processing machine as defined in claim 1 wherein vacuum means is provided for controlling the application of air suction to the suction cups in timed relation with the movement of the cups.

5. An envelope processing machine as defined in claim 4 wherein said vacuum means includes a suction pump and a relief valve operable in timed relation with the movement of the suction cups.

6. An envelope processing machine as defined in claim 1 wherein said cutting means comprises a pair of rotatable cutting knives, and wherein said envelope removing means comprises a suction cup operable upon the envelopes within the supply hopper.

7. An envelope processing machine as defined in claim 1 wherein the supply hopper comprises a generally horizontal table for envelopes, a feed belt, power drive means for the feed belt, and a control member actuated by the envelopes to control the power drive means.

8. An envelope processing machine as defined in claim 1 wherein the means for transmitting the envelopes to the cutting means comprises a shoe and roller assembly engageable with the face of the envelope as it approaches the cutting means.

9. An envelope processing machine comprising a supply hopper for envelopes, means for removing envelopes in one by one relationship from the supply hopper and for transmitting the removed envelopes in longitudinal alignment and in substantially horizontal disposition to a processing station, and envelope opening means comprising a pair of suction cups operable upon opposing faces of the envelope at said envelope processing station for disposing an envelope with each side thereof extending upwardly at an acute angle in respect to the horizontal and for opening an envelope and holding it open for manual insertion or removal of envelope contents.

10. An envelope processing machine as defined in claim 9 wherein said pair of suction cups is operable upon opposing faces of the envelope while the envelope is closed and disposed in a horizontal attitude, said suction cups thereafter being movable to dispose the envelope at said acute angle in respect to the horizontal and in open position.

11. An envelope processing machine comprising a supply hopper for envelopes, means for removing envelopes in one by one relationship from the supply hopper and for transmitting the removed envelopes one by one in longitudinal alignment and in substantially horizontal disposition to a processing station, and envelope opening means comprising a pair of suction cups operable upon opposing faces of the envelope at said envelope processing station for opening an envelope with each side thereof at an acute angle from horizontal and holding it open for manual insertion or removal of envelope contents with both sides of the opposed faces of the envelope exposed.

12. An envelope processing machine comprising a supply hopper for envelopes, cutting means for severing one edge of an envelope, means for removing envelopes in one by one relationship from the supply hopper and for transmitting the removed envelopes in longitudinal alignment and in horizontal disposition to the cutting means, means for orienting the envelopes in respect to the cutting means, means for transmitting the envelopes from the cutting means to an envelope opening station, and envelope opening means comprising a pair of suction cups operable upon opposing faces of the envelope at said envelope opening station for opening an envelope by moving each side thereof upwardly from horizontal position and holding it open for manual removal of envelope contents.

13. An envelope processing machine as defined in claim 12 wherein said orienting means comprises an angularly disposed feed belt and an abutment member against which an envelope is engaged by movement of the belt.

14. An envelope processing machine as defined in claim 12 wherein means is provided for adjusting the cutting means in respect to the orienting means.

15. An envelope processing machine as defined in claim 14 wherein said cutting means comprises a pair of cutting rollers, and said adjusting means comprises means for shifting said rollers as a unit.

16. An envelope processing machine as defined in claim 12 wherein means is provided for receiving a severed portion of the envelope from the cutting means, said receiving means comprising a guide member and a storage receptacle.

17. In a machine for holding an envelope having one separable edge in an open position in which the machine has a horizontal working surface with a forward edge accessible to a person standing or seated, a holding station on said horizontal surface rearwardly of said forward edge, conveyor means operable to convey envelopes in a single file parallel to said forward edge and in substantially the horizontal plane of said working surface through said holding station with the separable edge of envelopes toward said forward edge of said working surface, a pair of suction elements movable and operable to engage the opposite sides of one of said envelopes in said holding station, and sequentially operable means moving and operating said suction elements to apply said suction elements to the opposite sides of one of said envelopes in said holding station to grip said opposite sides of said one of said envelopes and to thereafter move said suction elements apart and contemporaneously translating said suction elements to open said envelope with both sides thereof upwardly at a substantial angle to said horizontal working surface and to thereafter hold said suction elements to hold said envelope open at said angle, and control means for operating said sequentially operable means.

18. In a machine as defined in claim 17 wherein said control means is manually operable.

19. In a machine as defined in claim 18, wherein said control means includes means manually operable to render said control means repeatingly operating said sequentially operable means.

20. In a machine as defined in claim 18, wherein said control means includes manually adjustable means for controlling the length of time said sequentially operable means is operated to hold said suction elements to hold said envelope open at said angle.

21. An envelope processing machine as defined in claim 10, wherein means is provided for adjusting the opening limit of the suction cups.

* * * * *